US012161270B1

(12) United States Patent
Spraul

(10) Patent No.: US 12,161,270 B1
(45) **Date of Patent: *Dec. 10, 2024**

(54) PIVOTING TOILET PAPER HOLDER

(71) Applicant: William Peter Spraul, Montgomery, NY (US)

(72) Inventor: William Peter Spraul, Montgomery, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/803,657

(22) Filed: Sep. 22, 2022

Related U.S. Application Data

(63) Continuation-in-part of application No. 17/300,493, filed on Jul. 19, 2021, now Pat. No. 11,478,113.

(51) Int. Cl.
*A47K 10/38* (2006.01)

(52) U.S. Cl.
CPC ..... *A47K 10/38* (2013.01)

(58) Field of Classification Search
None
See application file for complete search history.

(56) References Cited

U.S. PATENT DOCUMENTS 4,824,038 A * 4/1989 Chandler ..... A47K 10/3836 242/598.5
5,529,260 A * 6/1996 Wirick ..... A47K 10/38 242/596.8
5,690,301 A * 11/1997 Shelton ..... B65H 49/327 242/129
D393,165 S * 4/1998 Jensen ..... D6/523
5,871,170 A * 2/1999 Morales ..... A47K 10/40 242/598.2
5,967,452 A * 10/1999 Wilder ..... A47K 10/3836 D6/519
D424,668 S * 5/2000 Dangervil ..... D23/303
D427,829 S * 7/2000 Fleming ..... D6/523
6,305,035 B1 * 10/2001 Morris ..... A47K 11/04 242/588
7,306,185 B1 * 12/2007 Miller ..... A47K 10/3836 242/597
D600,478 S * 9/2009 Linyear ..... D6/523
D707,465 S * 6/2014 Hutchins ..... D6/523
9,016,649 B2 * 4/2015 Nolle ..... B65H 49/26 248/217.1
10,667,656 B2 * 6/2020 Jackson ..... A47K 10/3836
10,743,725 B2 * 8/2020 Scheimberg ..... A47K 10/40
11,478,113 B1 * 10/2022 Spraul ..... A47K 10/3836
2010/0083432 A1 * 4/2010 Osier ..... A47K 10/3836 4/254
2012/0181297 A1 * 7/2012 Cofrancesco ..... A47K 10/38 221/26
2020/0129016 A1 * 4/2020 Cuenca ..... A47K 10/3836

FOREIGN PATENT DOCUMENTS

DE 195 45 440 * 12/1997

* cited by examiner

*Primary Examiner* — William A. Rivera

(57) ABSTRACT

The novel rigid arm structure is a, two position, pivoting toilet paper holder. In the nonuse position, access to toilet paper not needed. The toilet paper is pivoted out of the way for normal bathroom activities. In the use position, the toilet paper is pivoted to an easy to reach position. The novel stop assist prevents toilet paper from continuing to roll out excess paper when paper is being torn off the roll. The system mounts on a vertical surface, a cabinet, or a handicap safety rail frame. The optional second toilet paper roll pivots along with the primary roll.

20 Claims, 23 Drawing Sheets

PIVOTING TOILET PAPER HOLDER

BACKGROUND OF THE INVENTION

1. Field of Invention

This system is related to toilet paper holders and more specifically to a toilet paper dispensing system for providing easy access to a roll of toilet paper in challenging bathroom configurations.

2. Description of the Prior Art

One prominent challenging bathroom configuration is a small bathroom layout with dimensions 5 ft. by 8 ft. providing the 3 essential plumbing fixtures, a sink in a cabinet, a toilet, and a bathtub. The minimum code space for a toilet can be a rectangle that is 30 inches in width which is parallel to the wall behind the toilet and 51 in. in length measured from the back of the wall forward beyond the end of the front of the toilet. This space is considered adequate for use of the toilet, but does not facilitate good placement for a toilet paper dispenser that would provide easy access to toilet paper. Where does the dispenser get mounted? One side is the bathtub with no place to mount a dispenser. A toilet paper holder mounted on the back wall is too far back to reach. A dispenser mounted on the side of a standard 21 in. width cabinet will, at best, be even with the shoulders of the user requiring the user to twist and turn to access the dispenser. The use of a toilet paper holder stand takes up floor space, it must be moved to clean the floor and most important is where to place it so as not to interfere with use of other fixtures. This dilemma has generated patents to address this problem. Patents that are related to the present system include the U.S. Pat. Nos. 1,226,463, 5,868,345, 6,405,971, 6,527,219, 5,871,170, 5,967,452, 10,743,725 B2, U.S. Pat. No. 7,306,185 B1, Des. 393,165 and DE 195 45 440 A1, The related patents above are similar in design using sliding, pivoting, flexible, and telescoping mechanisms. The mechanisms are substantial and in a minimum space application require the user to twist and turn to extend the mechanism if the user is seated first. Alternatively, the mechanisms can interfere with a user trying to sit down if the mechanism is already extended. The present system solves the above problems by pivoting the toilet paper out of the path for user to sit down and pivots the toilet paper roll to an ideal position to obtain toilet paper.

BRIEF SUMMARY OF THE INVENTION

This pivoting toilet paper roll system uses a novel pivoting rigid shaped arm. The arm is pivotally attached to a cabinet, or a vertical surface, using a base allowing the arm to pivot from a nonuse position to a use position. The rigid arm is made in the following order starting with one end of the arm being pivotally attached to the base, followed by a novel shaped segment, and lastly, followed by the second segment that supports the toilet paper roll. The shaped segment can be shaped in many ways to meet this system's objective. Some examples of different shaped segments are provided in the specification drawings that will meet the system's objective. The shaped segment used in a minimum space situation for a toilet, is shaped in a way that when the arm is pivoted, the toilet paper roll goes from a nonuse position that is next to the side of a cabinet, or vertical wall, to a use position that takes the toilet paper roll out of the user's path for sitting down. Now with the toilet paper roll in the use position, that is forward from the nonuse position, it is in an ideal position for the user to obtain toilet paper from the roll.

When in the ideal position, the user can obtain the amount of toilet paper desired, stop the roll, and tear off the paper using only one hand without having the toilet paper continuing to roll out more paper than needed. This is made possible by a the novel stop assist device using one or more toilet paper stop pegs. The stop assist toilet paper stop pegs are embedded in the stop assist structure with the pegs facing the toilet paper roll. The stop assist structure is mounted at either end of the rigid arm's second segment that supports the toilet paper roll.

There are many embodiments, alternatives and variations of the system. Some examples are, where space is not restricted, the toilet paper may be too far away from the user. A reverse, novel shaped arm with a modified base would be used to meet the objective of placing the toilet paper in an ideal position, close to the user and forward from the nonuse position. The reversed novel shaped segment of the pivoting arm, like the novel shaped segment above, so can the reverse novel shape segment be shaped in many ways to achieve this system's objective where space is not restricted.

The above embodiments can solve problems for people that find it difficult to twist and turn due their size, age, arthritis, being handicapped and many other reasons. Some require a handicap safety rail frame to safely get seated. Herein is an embodiment of the pivoting toilet paper holder system attached to a handicap safety rail frame.

A second toilet paper roll can be attached to all the systems and pivots to an ideal position with the primary roll. The system takes up no floor space, is small in size, and is inexpensive to make. All the systems described and illustrated herein can be easily made to be used on either side of a toilet, i.e. the design is reversible.

BRIEF DESCRIPTION OF DRAWINGS

FIG. 1B top view of the integral hinge.

FIG. 23A top view illustrating use position of system 10.

DESCRIPTION OF THE PREFERRED EMBODIMENT

Figure 1:
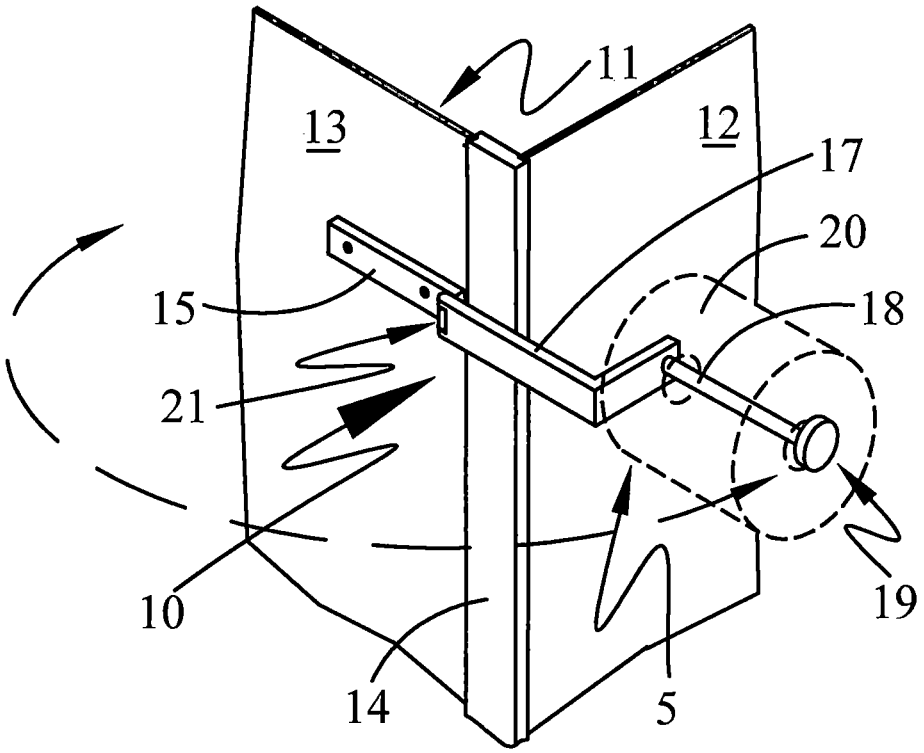
FIG. 1 is a perspective view of the preferred embodiment in the use position.

The system's preferred embodiments shown in the drawings and described here are many, ranging from the basic parts to more enhanced versions, but they are not intended to limit the system to these embodiments, alternatives and variations.

Figure 7:
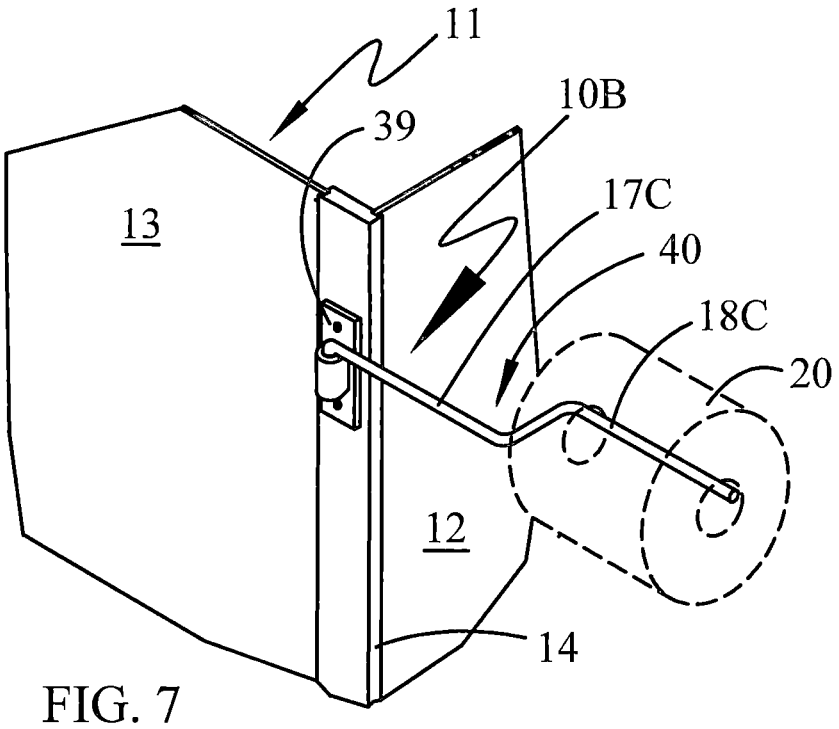
FIG. 7 most basic preferred embodiment, perspective view system 10B, 1 piece arm.

Note: the most basic preferred embodiment starts with FIG. 7, on page 7.

Figure 1A:
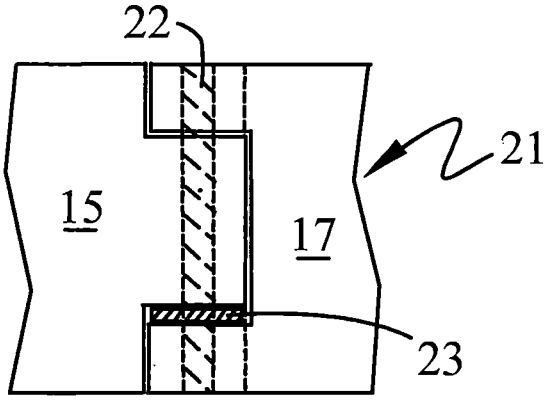
FIG. 1A side view of the integral hinge.
Figure 1B:
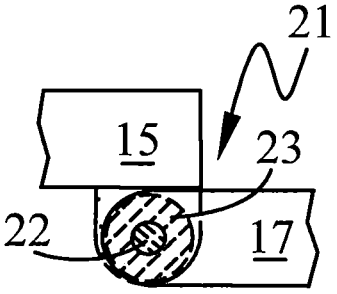

Referring to FIGS. 1, 1A, 1B, is an illustration of one of the preferred embodiments described herein, the pivoting toilet paper holder system 10 using a novel pivoting action system, shown in the use position with arrows describing the pivoting directions of movement. The system comprises the following description. A base 15 which is mounted to the left side 13 of cabinet 11. The base 15 has connected to it a rigid arm structure 5 comprising two segments, a first segment and a second segment. The first segment is a shaped segment 17. The shaped segment is connected to the base 15 using an integral hinge 21 constructed from the proximal end of the base 15, the proximal end of the shaped segment 17, a friction washer 23, and the pivot pin 22 as detailed in FIGS. 1A and 1B. The second segment supports the toilet paper roll 20. In this embodiment, the second segment is a toilet paper roll support 18. The proximal end of the toilet paper roll support 18 is connected to the distal end of the shaped segment 17. The shaped segment is shaped to position the toilet paper roll support 18 forward and around the corner of the cabinet 14 to be in the use position in the front of the cabinet 12. This puts the toilet paper roll 20 out of the path that the user will use to sit down. In this embodiment, the distal end of the support 18 has a novel stop assist 19 connected to it. The support 18 can be long enough in length to hold a toilet paper roll 20 with an additional amount of length added for the roll 20 to roll freely with consideration for the proper operation of the stop assist 19. Operation of the stop assist 19 is described later in the detailed description and FIGS. 4 to 4D.

The system 10 has a nonuse and a use position. There are many methods and approaches to insure the system will stay in the desired positions, nonuse and use. The weight alone of the shaped segment 17, the toilet paper roll support 18, the stop assist 19 and roll 20 will cause resistance to the pivoting action if made without a friction washer 23 that is shown in FIGS. 1A, 1B. This resistance alone may be enough to prevent wandering out of the desired positions, nonuse and use. FIGS. 1A, and 1B shows the integral hinge 21 made with a friction washer 23 that provides increased resistance to the pivoting action to aid in holding the desired positions. Later in the detailed description other methods will be described to have the system hold the nonuse and use positions properly.

FIG. 1B is a top view of the integral hinge 21 showing the pivot pin 22. Referring to FIG. 1, the system using the integral hinge 21 pivots the roll 20 to the front of the cabinet 12. In FIG. 1B the shaped segment 17 is in the use position with further pivoting being stopped when the shaped segment 17 contacts the base 15. The integral hinge 21 made as shown in FIG. 1B provides the shaped segment 17 clearance to get around the corner of the cabinet 14 as shown in FIG. 1. Not all cabinets have a corner 14 reveal protruding out. The system 10 can be connected to a wall and other vertical structures.

Figure 2:
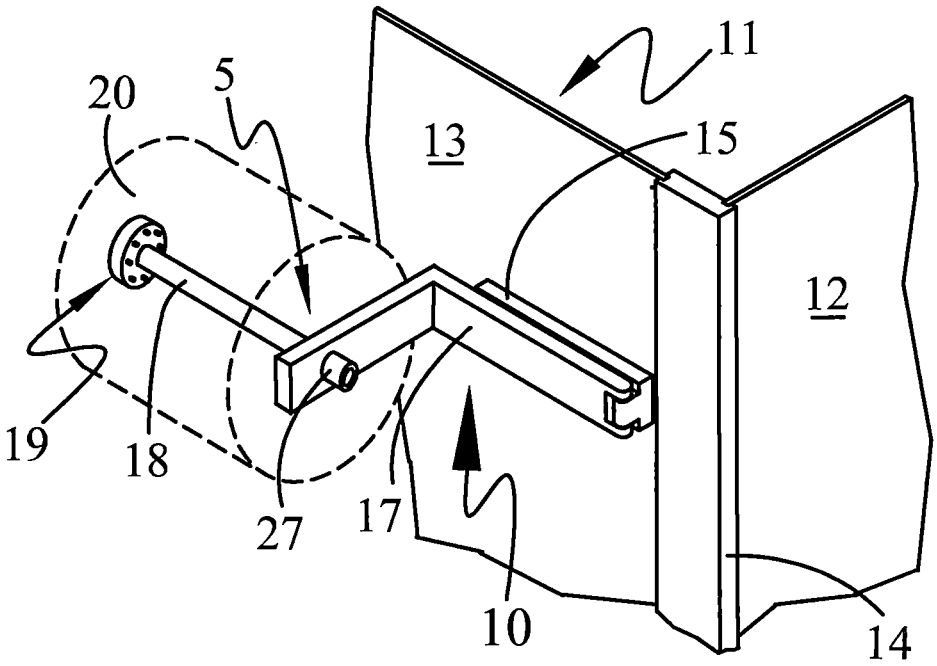
FIG. 2 perspective view of the preferred embodiment in the nonuse position.
Figure 2A:
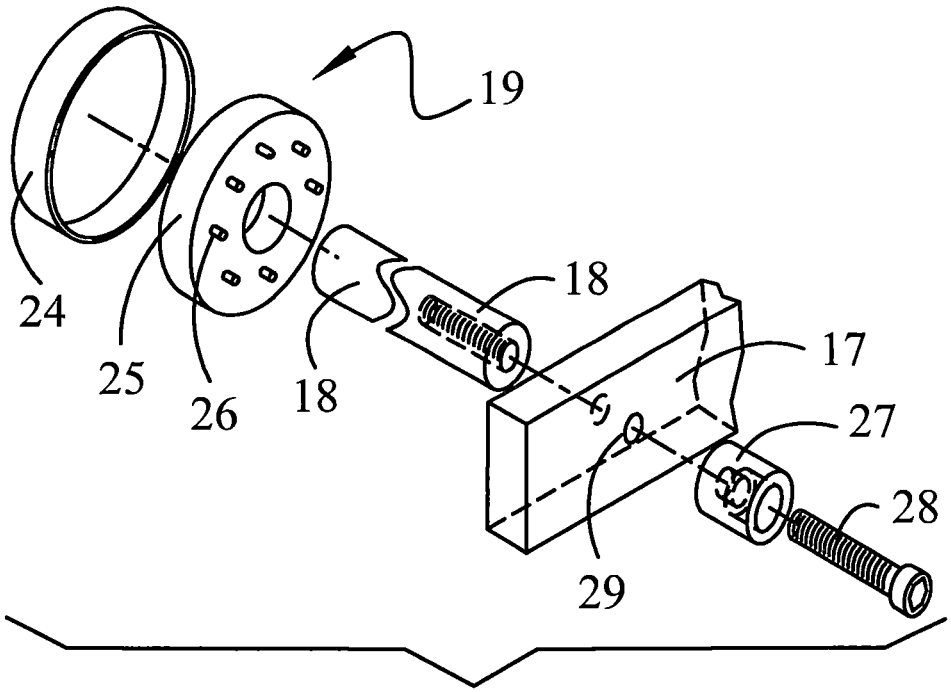
FIG. 2A exploded view of the stop assist.

In FIG. 2 the system 10 is in the nonuse position. This would be the position when the toilet paper does not need to be accessed. When a user needs to use the toilet, the user would pivot the system 10 by putting their finger on the pivoting push knob 27 and push in the direction of the toilet and continue to push until it reaches the use position. The user would use the same knob 27 to pivot the system 10 back into the nonuse position. In FIG. 2A the support 18 is connected to the segment 17 by an Allen screw 28 that passes through the knob 27, then continues on to pass through the hole 29 that is in distal end of segment 17 and screws into the threads in the proximal end of support 18. Any surface on the segment 17 or the toilet paper 20 could be used to pivot the system 10. The pivoting push knob 27 provides a designated surface to use to pivot the system 10 that can be easily kept clean.

Figure 13:
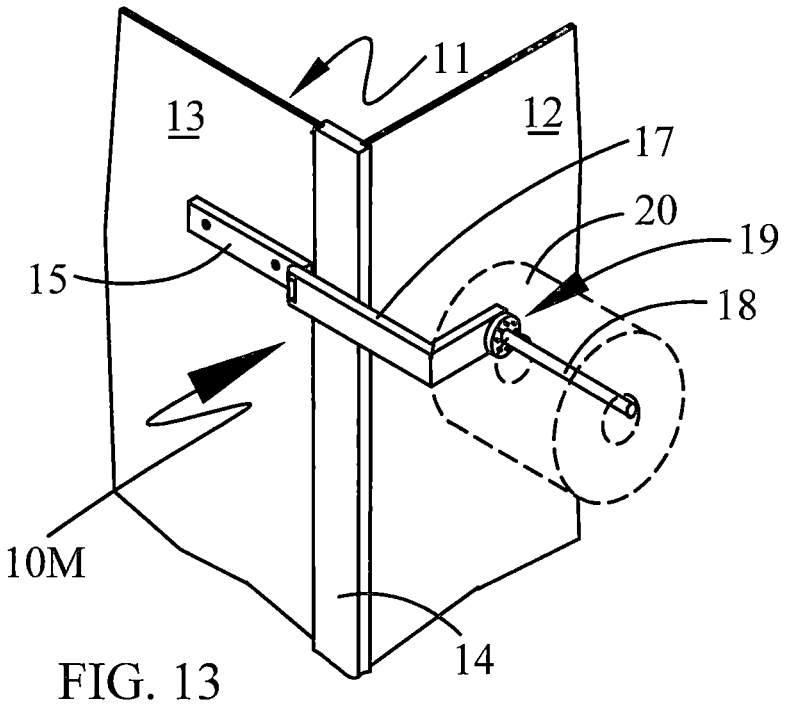
FIG. 13 view of the preferred embodiment, system 10M, with stop assist at opposite end.
Figure 13A:
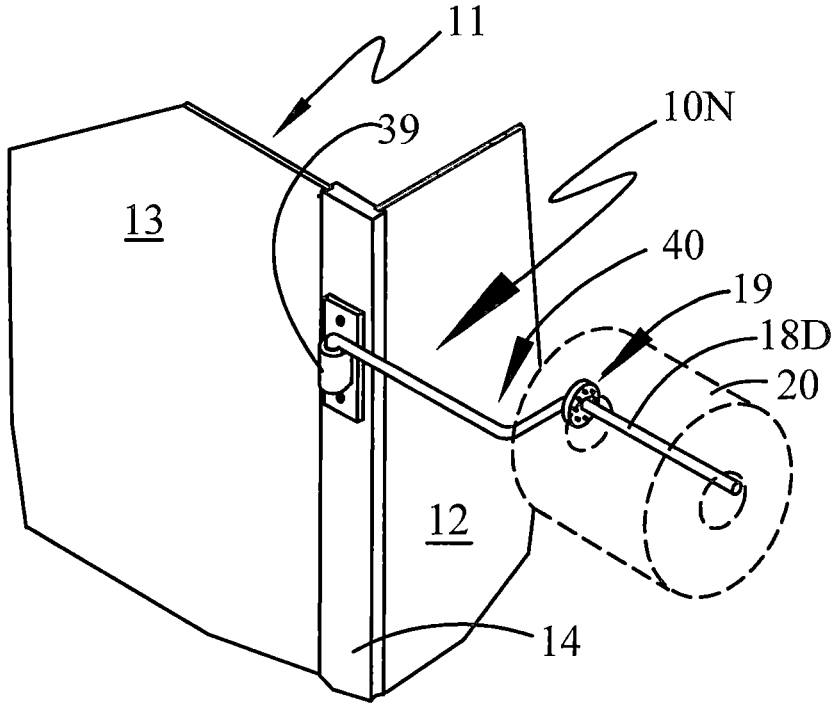
FIG. 13A view system 10N, 1 piece, with stop assist at opposite end.
Figure 15:
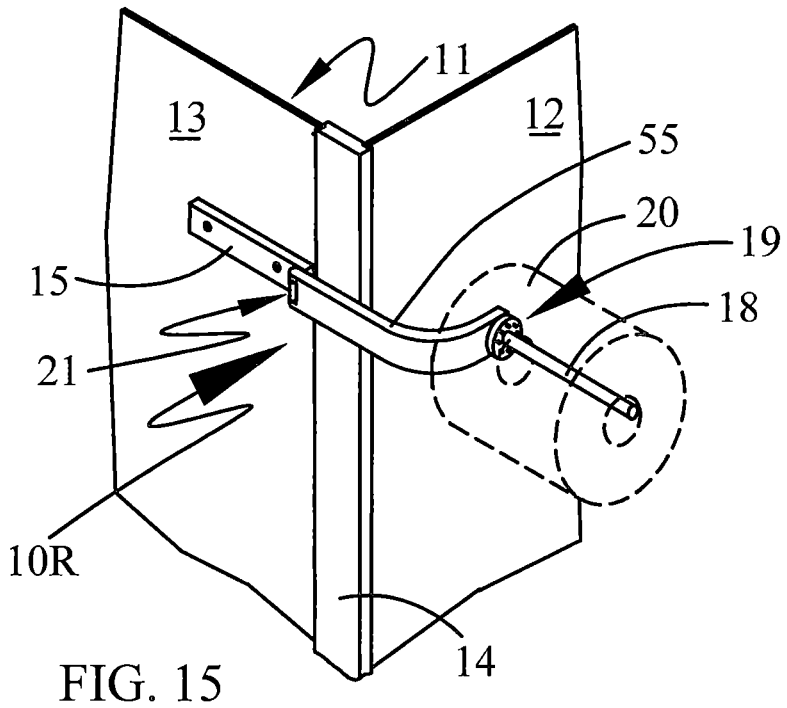
FIG. 15 perspective view system 10R, 2 piece with curved shaped, stop assist.

In FIG. 2A the novel stop assist 19 is comprised of a stop ring 25 with one or more of toilet paper stop pegs 26 that are embedded into ring 25 that face shaped segment 17, and a stop assist cap 24 that covers the ring 25 that can be made to be decor consistent with the system 10. The stop assist 19 diameter can be small enough so a roll 20 can easily be slipped over the stop assist 19 for installing and removing the roll 20. The stop assist 19 diameter can be larger when the stop assist 19 is made to be removed to install a toilet paper roll 20 or when the stop assist 19 is located at the opposite end of a toilet paper roll support 18, or the proximal end of the second segment for supporting a toilet roll 20, as shown in FIGS. 13, 13A and 15. The stop assist 19 can have the one peg 26 or more pegs 26 positioned in the stop assist 19 for proper operation of the stop assist 19. Details on the stop assist operation are described later in the detailed description. The ring 25 in this embodiment is made of hard rubber. The ring 25 can be made of many other materials. The materials that can be used to make the ring 25 and the pegs 26 as well as the entire system will be addressed later in the detailed description. The pegs 26 can be rounded at the ends so they do not pose a danger to the user. One way to install the pegs 26 is to the ring 25, but not the only way, is to have a hole with the proper diameter in each position a peg 26 is to be embedded. The pegs 26 are then pushed into the holes. One way to install the ring 25 is to have a hole in the center of the ring 25 with a diameter slightly smaller than that of the support 18 so the ring 25 can be pushed on to the support 18 creating a secure fit. There are many other ways to attach the ring 25. The ring 25 has a stop assist cap 24 that can have an inside diameter slightly smaller than ring 25 such that the stop assist cap 24 will have a secure fit covering the ring 25. Again this is one way to attach the stop assist cap 24. There are many other ways to attach the stop assist cap 24. The support 18 length can be made to have a toilet paper roll 20 roll freely without being contacted by any peg 26.

Figure 3:
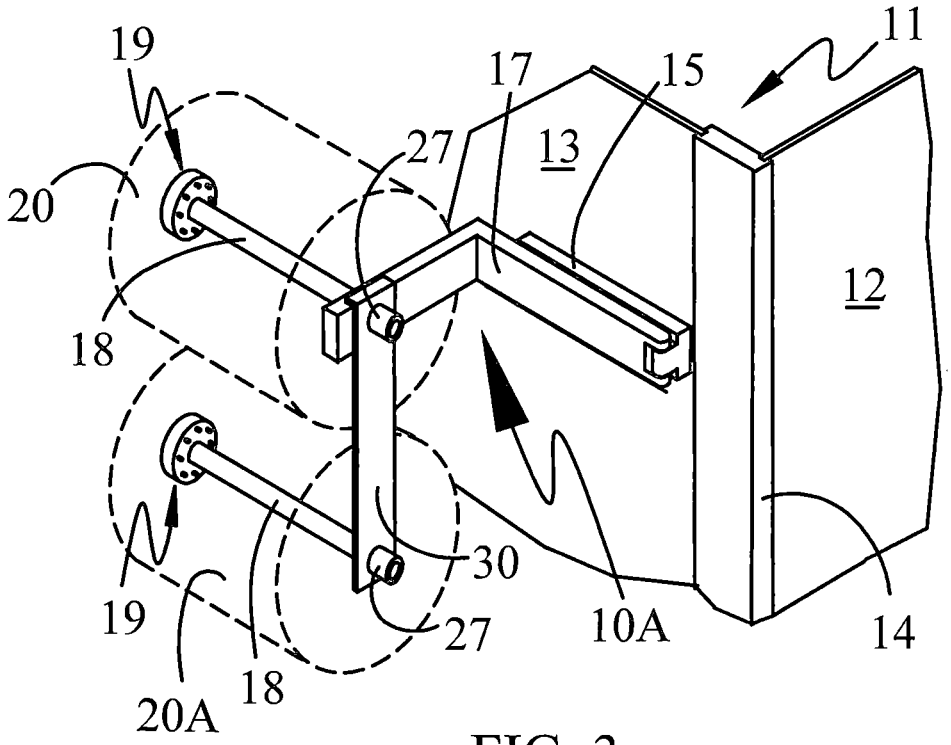
FIG. 3 perspective view of second toilet paper roll connected.
Figure 3A:
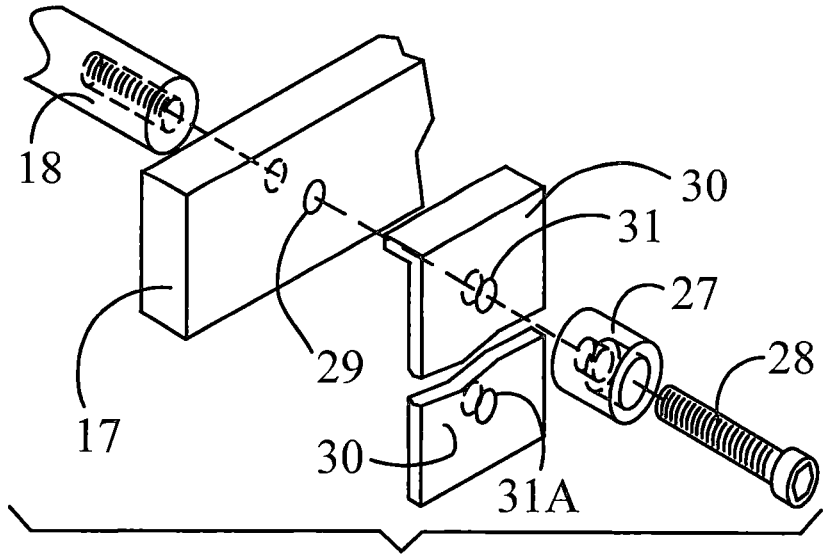
FIG. 3A exploded view of second toilet paper connector and knob.

FIG. 3 shows how a second toilet paper roll support 18 can be connected to the pivoting system 10. The system with the second roll support 18 is shown as system 10A and is mounted on the left side 13 of cabinet 11 which also has a front 12. There are many ways a second toilet paper roll can be connected to a system, this shows one way. The second roll connector 30 connects to the shaped segment 17. FIG. 3A shows the detail how connector 30 can be attached to the shaped segment 17. The connector 30 has a hole 31 in proximal end that lines up with hole 29 in the distal end of segment 17. Screw 28 passes through knob 27, then continues on to pass through hole 31 and 29 finally screwing into the threads at the proximal end of support 18. Connector 30 has a hole 31A at the distal end to connect the additional parts required to support second roll 20A. The additional parts that will be used to provide support for the second roll 20A could be the same parts used for the single roll system 10, specifically, support 18, stop assist 19, knob 27, and screw 28.

Figure 4:
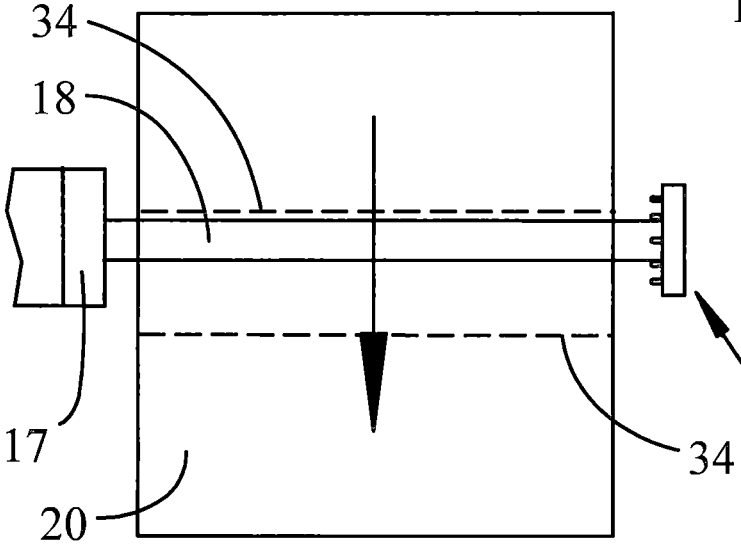
FIGS. 4, 4A, 4B, 4C, 4D illustrates operation of stop assist.
Figure 4A:
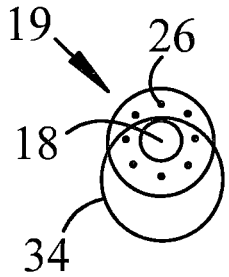
Figure 4B:
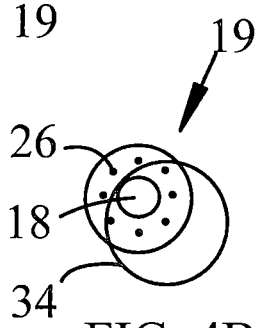
Figure 4D:
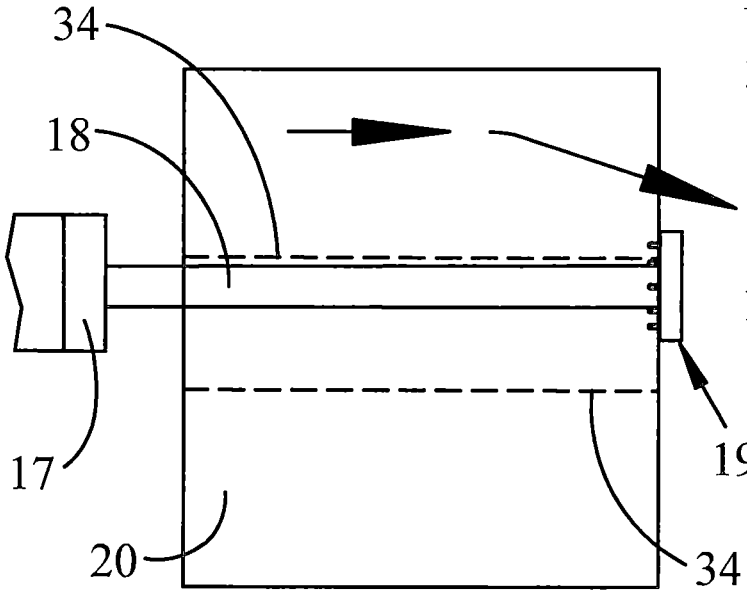

FIGS. 4-4D illustrate how the novel stop assist 19 operates and the relationship sizes of component parts. The toilet paper roll 20 has a center roll 34 that the toilet paper is wrapped around to form the toilet paper roll 20. The diameter of the stop assist 19 can be smaller than the diameter of the center roll 34 so the toilet roll 20 can easily be slipped over the stop assist 19 for installation and removal of roll 20 on the support 18. The stop assist 19 diameter can be larger when the stop assist is made to be removed to install toilet paper roll or when the stop assist is located at the opposite end of the toilet paper roll support 18 or the proximal end of the second segment for supporting a toilet paper roll 20 as shown in FIGS. 13, 13A and 15. The stop assist 19 can have the one peg 26 or more pegs 26 positioned in the stop assist 19 for proper operation of the stop assist 19.

In FIG. 4 the length of the support 18 adequately gives room for the toilet paper roll 20 to freely roll without coming in contact with the pegs 26. The user operation would start with the roll 20 being closer to the segment 17 rather than other end of support 18 as shown in FIG. 4. Then the user would pull the toilet paper roll 20 in the direction indicated by the arrow in FIG. 4 until the desired amount had been reached. Then, as shown in FIG. 4D, the user, with a finger, would slide the toilet paper roll 20 towards and into the pegs 26 as indicated by the arrow. Finally, the user would tear off the paper in the direction of the following arrow. The user, most likely, will learn that the operation of sliding the toilet paper roll 20 into the pegs 26 and tearing the paper can be accomplished in one motion.

Figure 4C:
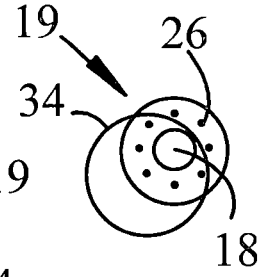

In FIGS. 4A-4C, the physical relationship between the center roll 34, the support 18 and the stop assist 19 containing the pegs 26 is illustrated. The illustration FIG. 4A shows a finite number of pegs 26 for this discussion, but it is not meant to suggest this is the correct number to be used. In a particular implementation one peg 26 can be sufficient for proper operation. FIG. 4A describes the use of a plurality of pegs 26 where after the roll 20 has been slid towards the stop assist 19, only the top most 3 pegs 26 actually engaged with the toilet paper roll 20 in this particular case. It may appear that only the top 3 pegs 26 are needed. FIGS. 4B and 4C illustrates a possible effect of the toilet paper roll 20 when a user makes a single motion of pulling the paper towards the stopper 19 and tearing off the paper in one motion, especially when the toilet paper roll 20 is getting close to empty and lighter in weight. The center 34 of the toilet paper roll 20 shifts about the support 18 with the result being that different pegs 26 will engage the toilet paper roll 20 than in FIG. 4A. Further, when the toilet paper roll 20 is very close to empty the toilet paper roll 20 may jump so much that the pegs 26 on the bottom will be the ones that will penetrate the toilet paper roll 20. That is why having the pegs 26 be mounted around the entire ring 25 may be considered. The pegs 26 can be rounded at the ends so they do not pose a danger to user and will still penetrate the toilet paper.

Earlier in FIG. 1A it was stated there are many methods and approaches to insure the system will stay in the desired positions. Two were described. One was the weight alone of the shaped segment 17, the toilet paper roll support 18, the stop assist 19 and roll 20 will cause resistance to the pivoting action if made without a friction washer 23 that is shown in FIGS. 1A, 1B. This resistance alone may be sufficient to prevent wandering out of the desired positions, nonuse and use. In FIGS. 1A and 1B, a second method was installing a friction washer 23 would possibly increase the resistance enough to keep the positions held.

Figure 5A:
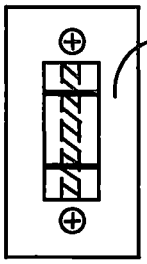
FIGS. 5, 5A, 5B, 5C, 5D, 5E, 5F illustrates hinge base shim to hold positions.
Figure 5B:
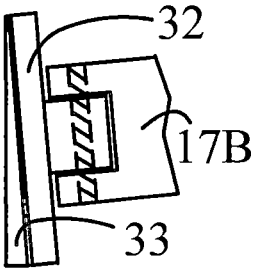
Figure 5:
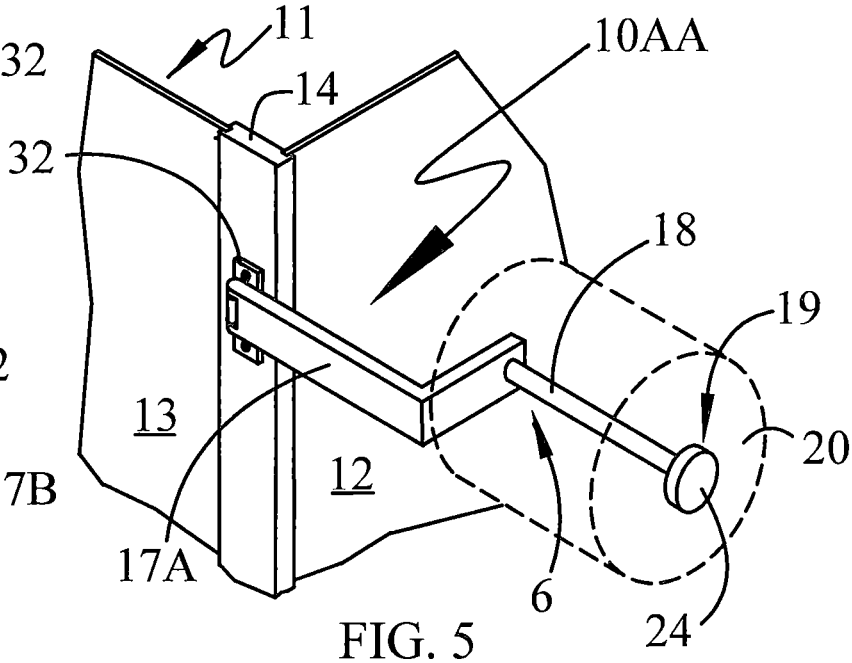
Figure 5C:
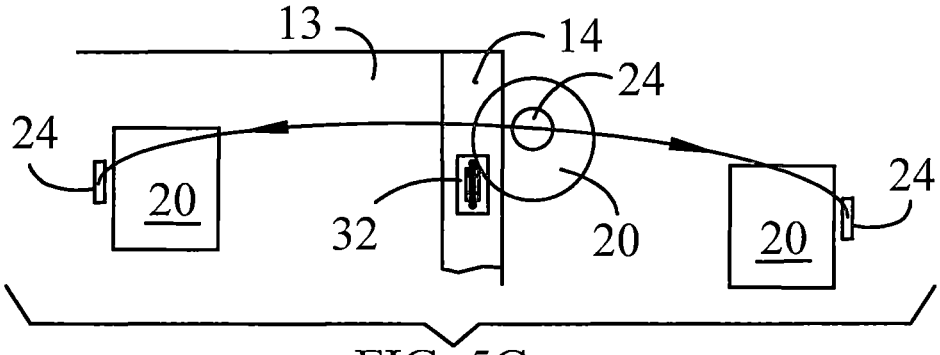
Figure 5D:
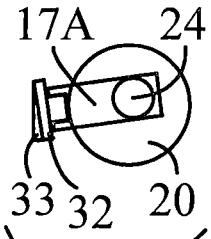
Figure 5E:
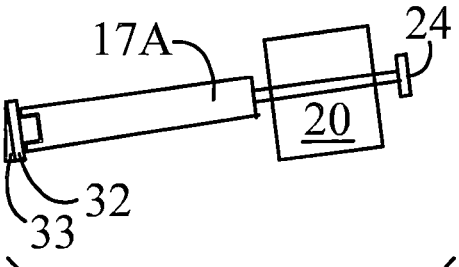
Figure 5F:
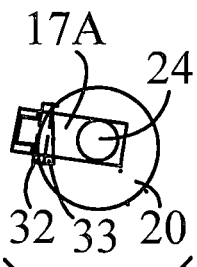

A third method to have the system stay in the desired positions is with the use of gravity. In FIGS. 5-5F system 10A is the same as system 10 in FIG. 1, except system 10AA uses a rigid arm structure 6, a integral hinge base 32, a hinge base shim 33, and the shaped segment 17A. The base 32 is mounted on the corner 14 of cabinet 11. The pivoting shaped segment 17A and toilet paper roll support 18 is shown in the use position which is in front 12 of the cabinet 11. The base 32 in FIGS. 5A, and 5B, does not have the friction washer 23 as in FIG. 1A, 1B, so that shaped segment 17A and toilet paper roll support 18 can pivot freely with the least amount of resistance as possible. In FIG. 5B a shim 33 moves the bottom of base 32. The top of base 32 does not move. The effect on the system 10AA is shown in FIGS. 5D, 5E, and 5F. In FIG. 5D the system 10AA is in the nonuse position next to the left side 13 of the cabinet 11 and the view is the end of system 10AA. The distal end of shaped segment 17A is slanted up from where it would be without the shim 33 installed. The stop assist cap 24 is also higher. In FIG. 5F the system is in the use position and the view is the end of system 10AA. The distal end of shaped segment 17A is now in the opposite position of the view in FIG. 5D. The shaped segment 17A is slanted down and the stop assist cap 24 is down. In FIG. 5E the system 10AA is in the middle of the pivoting travel from use to nonuse positions. The shaped segment 17A is facing outward from the corner 14 of the cabinet. The view is the end of system 10AA. Both the shaped segment 17A and the stop assist cap 24 are higher than that in FIG. 5D and FIG. 5F. The 3 positions just described are shown in FIG. 5C. The arrows show the pivoting travel between the use and nonuse positions. Since the stop assist cap 24 in both use and nonuse positions are lower than when the user starts to push the system 10AA, if the user stops pushing, gravity will pivot the system 10AA to one of the desired positions and keep it there. This permits the user to simply push the shaped segment 17A pass the high point toward the desired position. The system 10AA will go to the desired position and stay there. The base 32 used in this description and illustration is different than the base 15 in the preferred embodiment. Please note that pivoting toilet paper holder system 10 is shown with a number of different bases throughout the detailed description. All of the systems shown could use the gravity method of holding positions by tilting the system.

Figure 6:
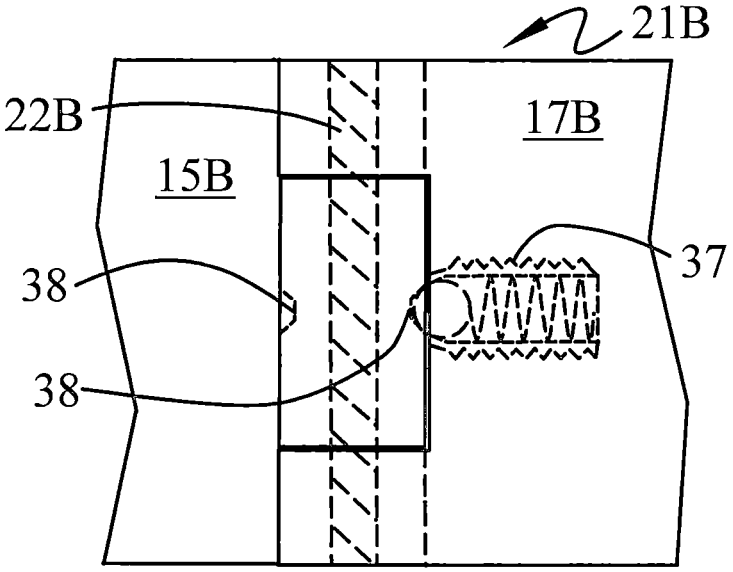
FIGS. 6, 6A, 6B, illustrates ball spring plunger and spring option to hold positions.
Figure 6A:
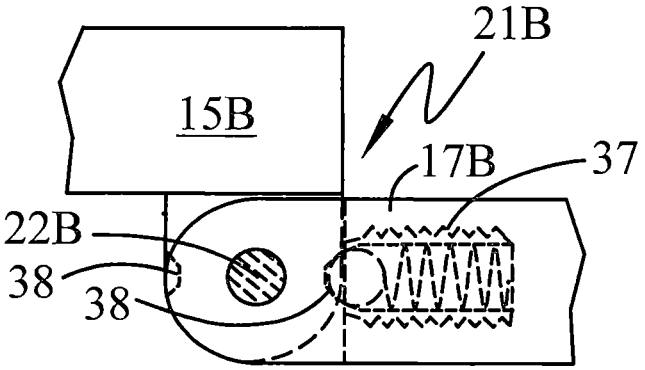

A fourth method to have the system stay in the desired positions is shown in FIGS. 6 and 6A by using a ball spring plunger 37. FIG. 6 is a side view of integral hinge 21B and FIG. 6A is a top view of integral hinge 21B which is similar in design to integral 21 as shown in FIG. 1 but does not have the friction washer 23 and does have the addition of plunger 37. The plunger 37 is screwed into the shaped segment 17B which pivots about pivot pin 22B. Push in plungers are available that simply slide into the a drilled hole rather than using a threaded hole. The base 15B has holes 38 drilled as shown to receive the ball of the plunger 37. The holes 38 are to correspond with having the shaped segment 17B being aligned so the plunger 37 will detent at the two positions use and nonuse. There are many other types of detents that can be used.

Figure 6B:
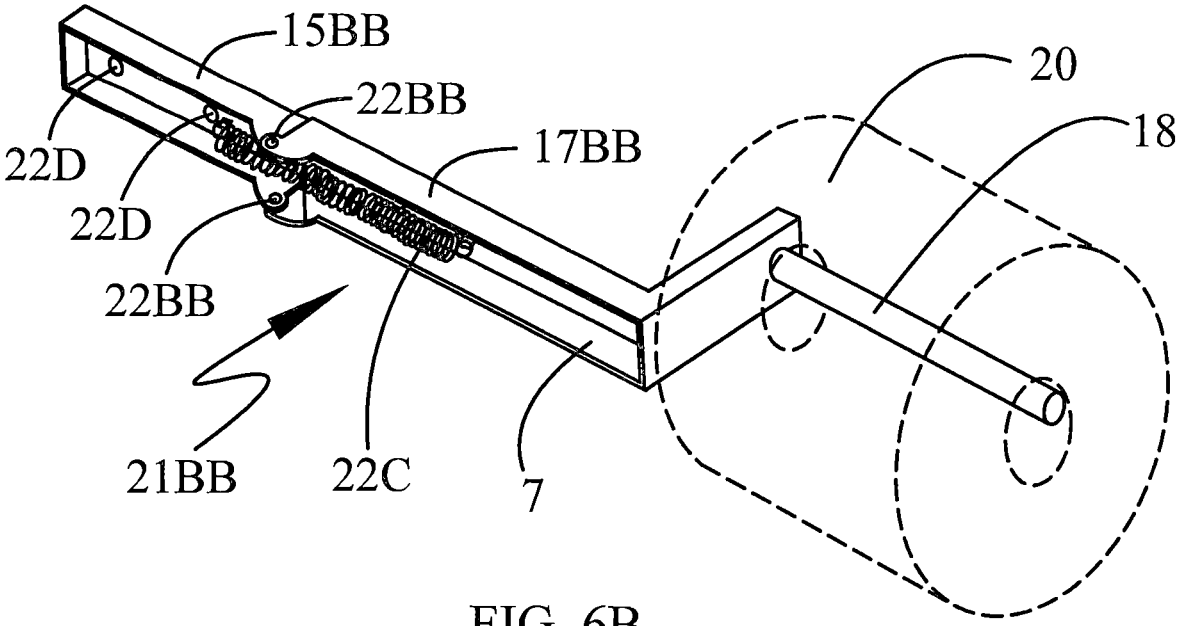

A fifth way Another method is the use of a drop leaf spring support shown in FIG. 6B. The system 21BB comprises, a base 15BB to be mounted to the cabinet or vertical surface, a rigid arm structure 7 comprising a shaped segment 17BB and a second segment comprising a toilet paper support 18 to support toilet paper roll 20. The structure 7 pivots about the pivot pins 22BB. With the use of the spring 22C, the desired positions would be held. Holes 22D can be used to mount the base.

There are other embodiments, variations and alternatives of the pivoting toilet paper holder system that will be described in the following pages along with corresponding figures. In the following figures a stop assist 19 will be added to some of the systems. The stop assist 19 is a novel device that can be positioned at the end of a roll support 18 as in FIG. 1 or at the opposite end of the toilet paper roll support 18 or the proximal end of the second segment for supporting a toilet paper roll 20 as shown in FIGS. 13, 13A and 15. An exploded view with a detailed description can be found in FIG. 2A. The operation of the stop assist 19 can be found in FIGS. 4 through 4D.

In FIG. 7, system 10B is shown using a base 39 mounted to the corner 14 of cabinet 11. The proximal end of the rigid arm structure 40 is pivotally connected to the base 39. The rigid arm structure 40 is made as a structure having two segments, a first segment 17C and a second segment 18C. The first segment 17C is a shaped segment that is a shaped segment 17C, as shown, that when the rigid arm structure 40 is pivoted, it will pivot the second segment 18C that supports the toilet paper roll 20 from the nonuse position that is right up next to the side 13 of the cabinet 11 as shown in FIG. 7A, to the use position that is forward and around the front 12 of cabinet 11 as shown in FIG. 7.

Figure 7A:
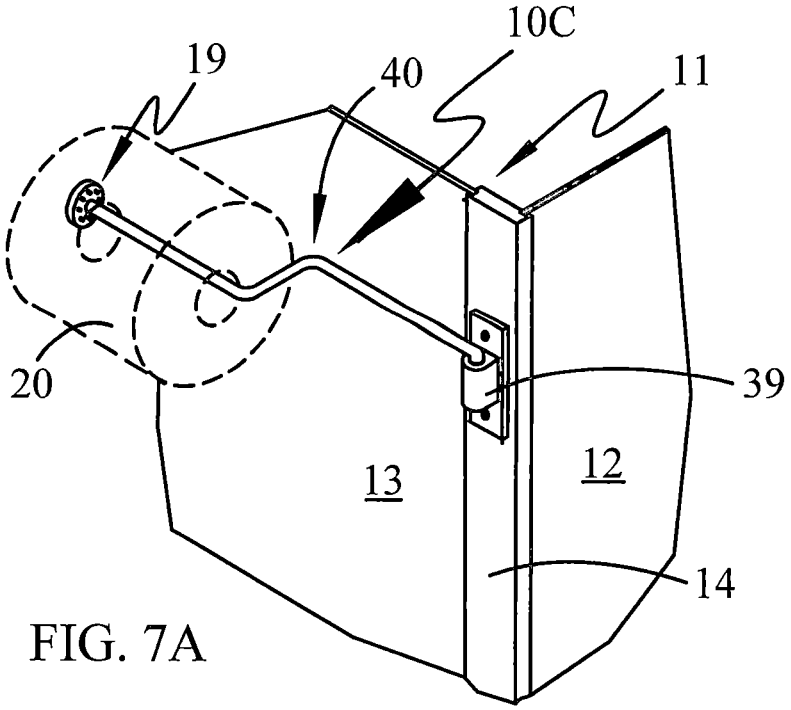
FIG. 7A perspective view system 10C, 1 piece, stop assist.

In FIG. 7A, system 10C is made like system 10B with one exception, system 10C uses a stop assist 19 that is attached to the distal end of arm 40.

Figure 8:
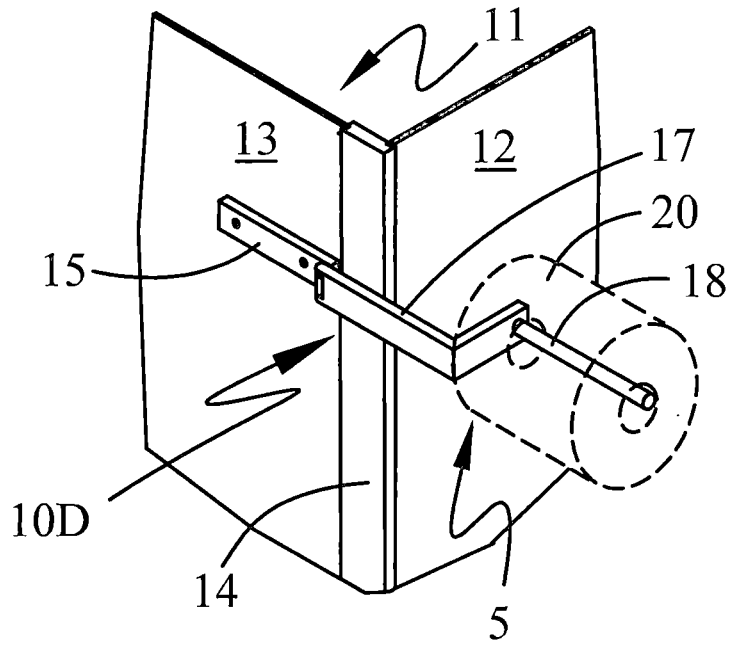
FIG. 8 perspective view system 10D, 2 piece.

In FIG. 8, system 10D is made like the preferred embodiment that is described and shown in FIG. 1, except system 10D does not have a stop assist 19.

Figure 8A:
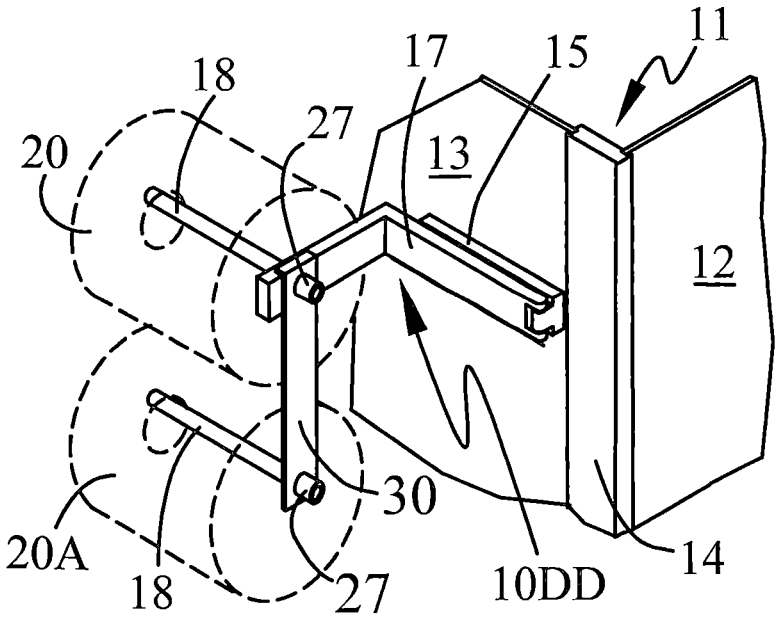
FIG. 8A perspective view system 10DD, 2 piece, 2 roll.

In FIG. 8A, system 10DD is made with a second roll connector 30 and associated parts that are the same as used in system 10A that is described and shown in FIG. 3 with the exception that 10DD does not have a stop assist 19 on either of the two supports 18.

Figure 9:
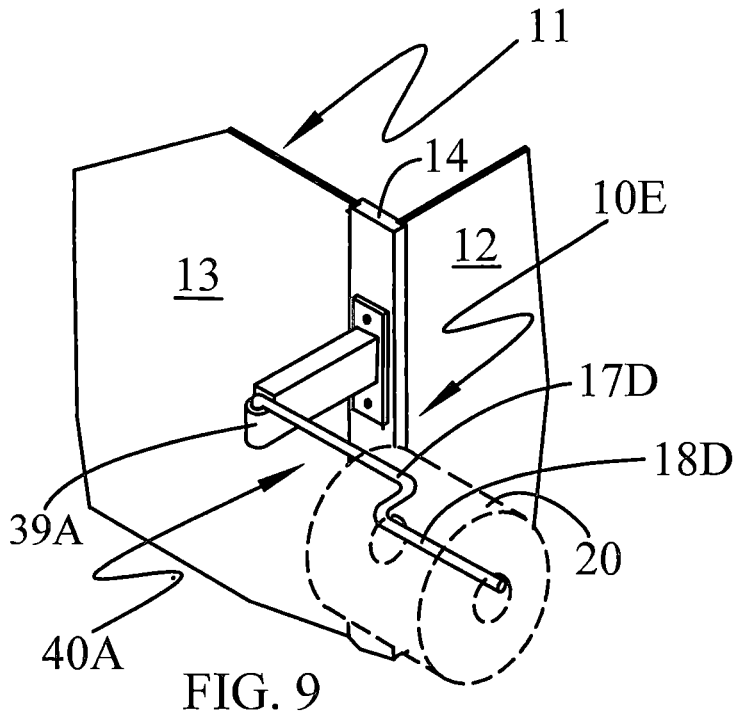
FIG. 9 perspective view system 10E, 1 piece, elongated base.

In FIG. 9, system 10E, is the same as system 10B in FIG. 7, with the following exceptions, the base 39A on system 10E is an elongated base and rigid arm structure 40A on system 10E is the same as the rigid arm structure 40 on system 10B, except the shaped bends of rigid arm structure 40A of system 10E are in opposite directions than those of rigid arm structure 40 of system 10B.

Figure 9A:
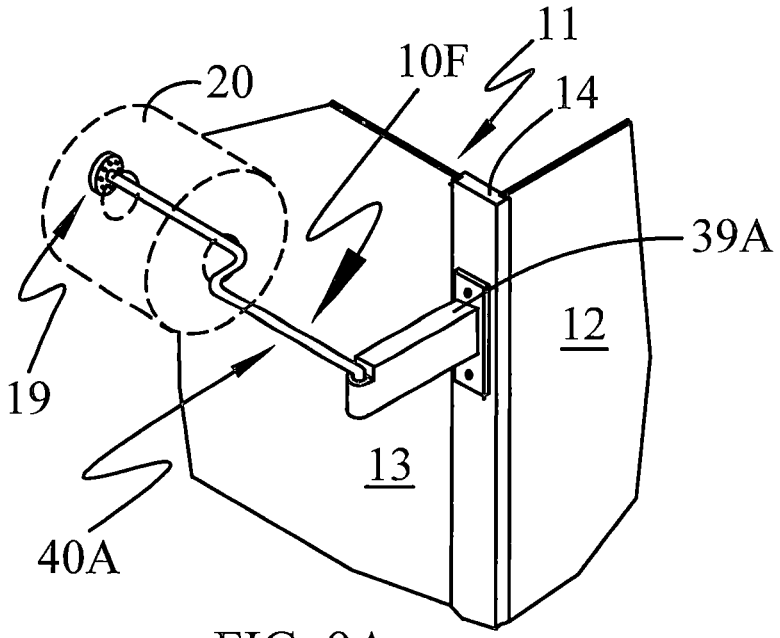
FIG. 9A perspective view system 10F, 1 piece, elongated base, stop assist.

In FIG. 9A, system 10F, is the same as system 10E, with the following exception, system 10F has a stop assist 19 that is attached to the distal end of rigid arm structure 40A.

Figure 10:
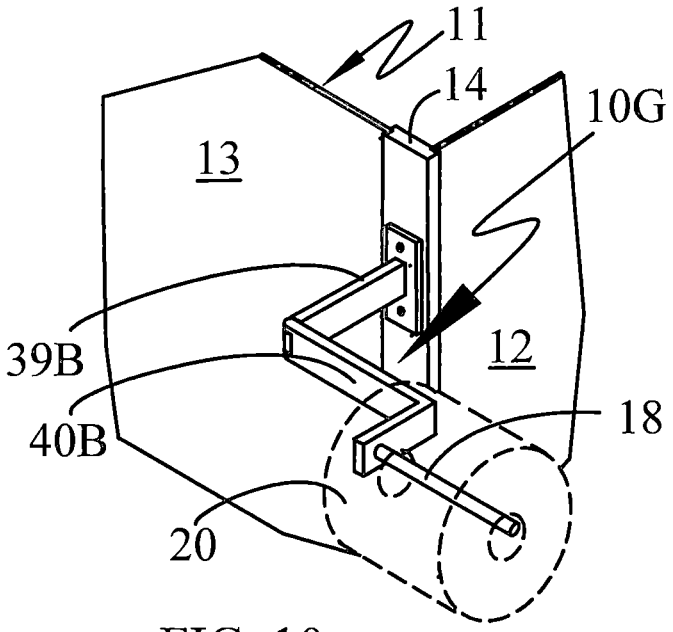
FIG. 10 perspective view system 10G, 2 piece, elongated base.

In FIG. 10, system 10G is shown in the use position and uses an elongated base 39B, and a shaped segment 40B shaped like shaped segment 17 in system 10D in FIG. 8 with the exception of having the distal end of shaped arm 40B facing in the opposite direction of distal end of the shaped segment 17 of system 10D as shown in FIG. 8, and having the same roll support 18 as shown in system 10D in FIG. 8.

Figure 10A:
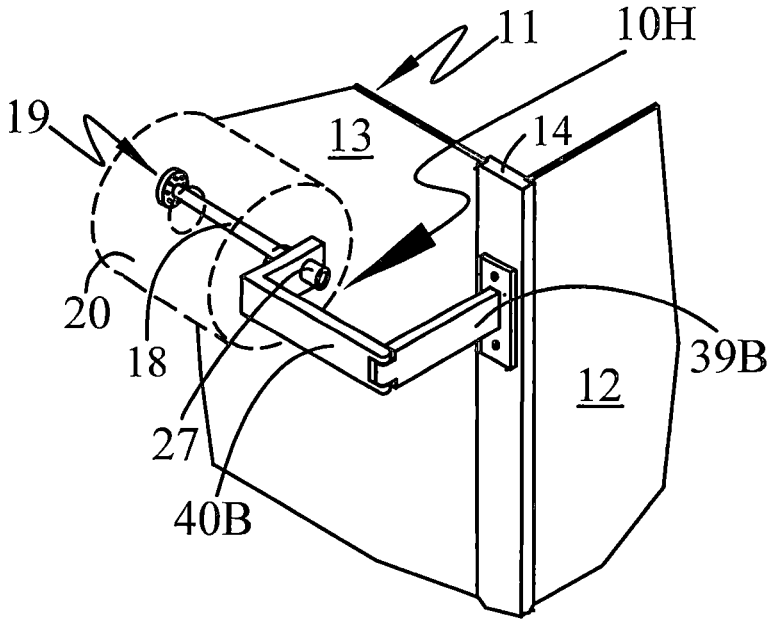
FIG. 10A perspective view system 10H, 2 piece, elongated base, stop assist.

In FIG. 10A, system 10H is shown in the nonuse position and is the same as system 10G in FIG. 10, except system 10H roll support 18 has a stop assist 19 mounted at the distal end of roll support 18, as shown in FIG. 10A.

Figure 11:
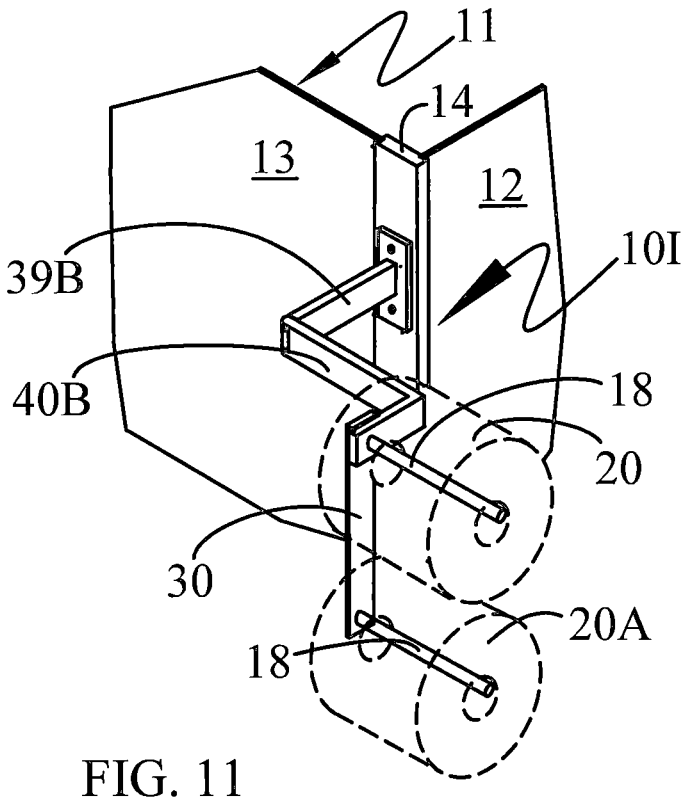
FIG. 11 perspective view system 10I, 2 piece, elongated base, 2 roll.

In FIG. 11, system 10I is the same as system 10G in FIG. 10, with the exception that system 10I includes a second roll capability using the same parts as system 10DD shown in FIG. 8A for the addition of a second roll 20A. System 10I is shown in the use position.

Figure 11A:
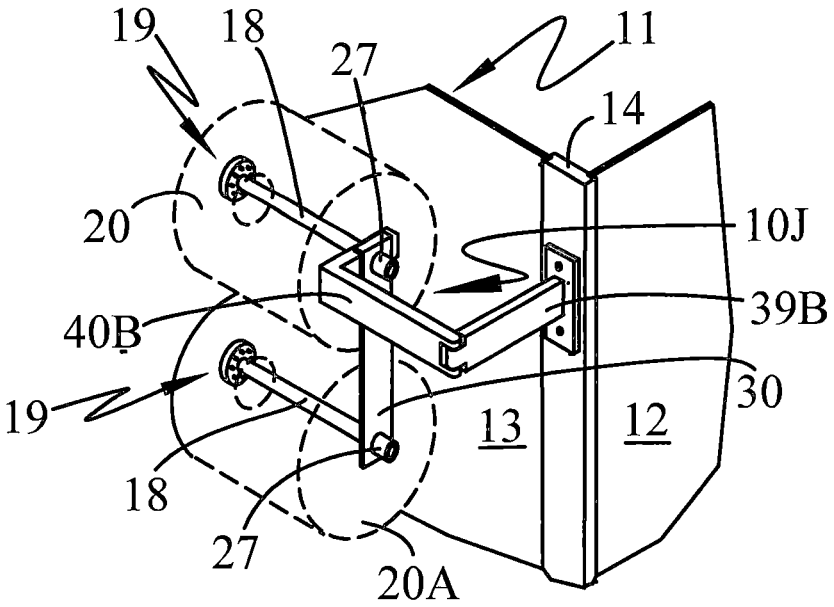
FIG. 11A perspective view system 10J, 2 piece, elongated base, 2 roll, stop assist.

In FIG. 11A, system 10J is the same as system 10I in FIG. 11, with the exception that system 10J includes a stop assist 19 on both roll supports 18. System 10J is shown in the nonuse position.

Figure 12:
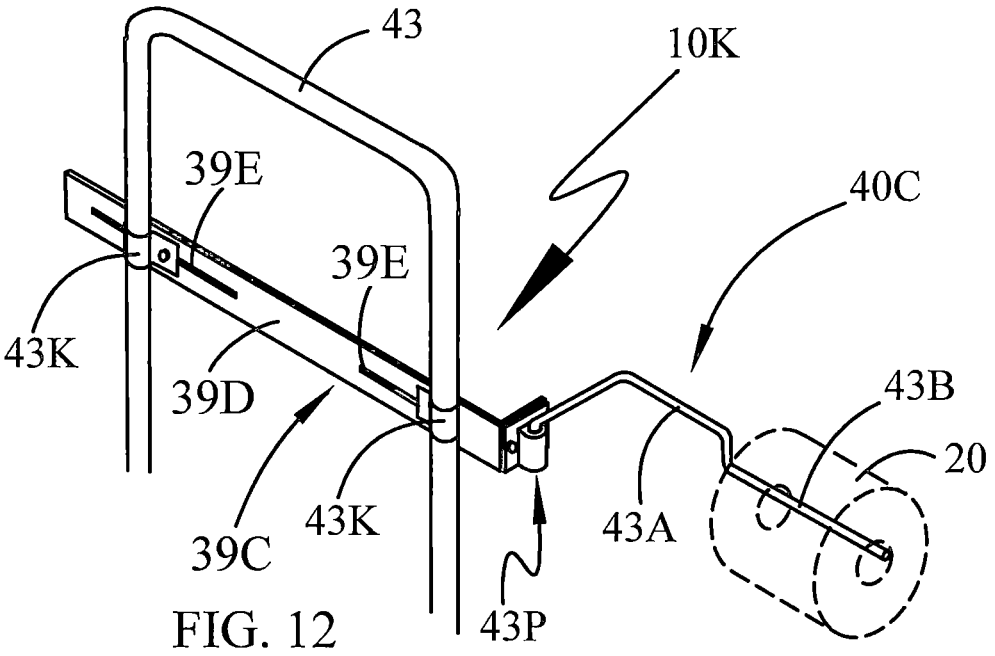
FIG. 12 perspective view system 10K, pivoting toilet paper holder attached to a handicap toilet safety rail frame base.
Figure 12A:
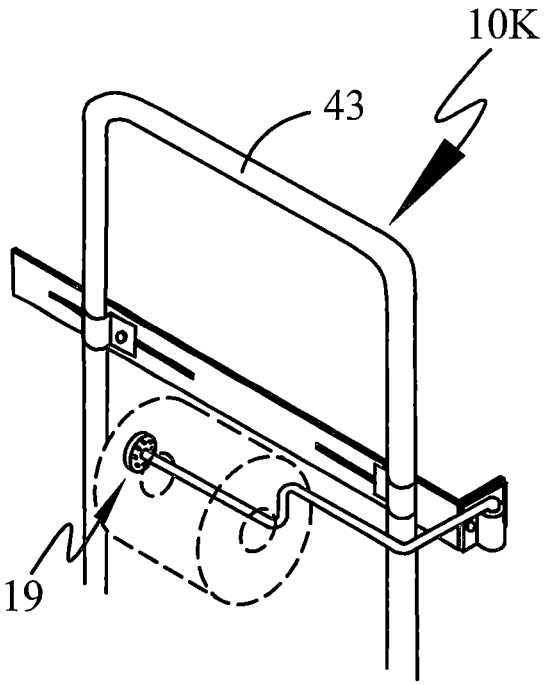
FIG. 12A perspective view system 10K, handicap toilet safety rail base, stop assist.
Figure 12B:
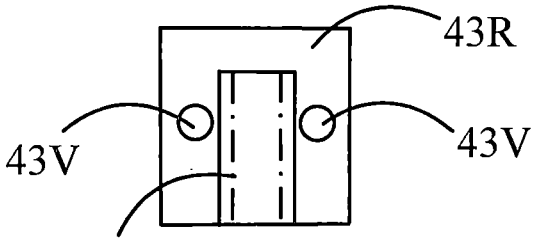
FIG. 12B, 12C, 12D pivoting adjustable, attachment parts of system 10K.
Figure 12C:
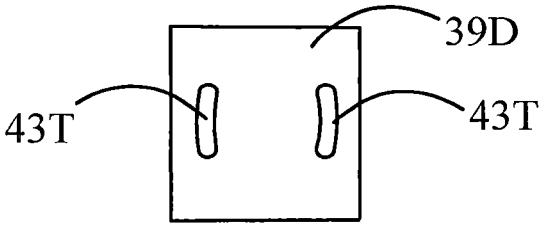
Figure 12D:
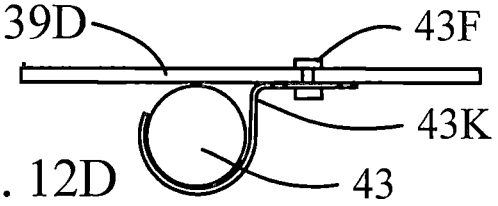

In FIG. 12, system 10K is shown in the use position. System 10K is a pivoting toilet paper holder system using a base that can be mounted on a handicap toilet safety rail frame. The toilet safety rail frame goes by many other names. To name a few, toilet grab bar, stand alone safety, universal safety frame, etc. Here it is called a toilet safety rail frame. The base 39C attaches to the safety rail 43 as show in FIG. 12. The base is made to be flexible in many directions to be compatible to many of the toilet safety frames available. The base 39C consists of a structure 39D that over spans the safety rail frame 43, one-hole clamps 43K, fastening hardware 43V, a rotating pivot assembly 43P consisting of the end of structure 39D shown in FIG. 12C and pivot plate 43R shown in FIG. 12B. The slots 39E in structure 39D work together with the one hole clamps 43K to allow the structure 39D a wide range in adjustability. In FIG. 12D the one hole clamps are shown. The rigid arm 40C is pivotally connected to the rotating pivot assembly 43P. The arm 40C has a shaped segment 43A shaped to have the second segment 43B pivot the toilet paper from the position shown in FIG. 12, the use position, to the nonuse position shown in FIG. 12A.

In FIG. 13, system 10M is made like system 10D in FIG. 8 with the exception that system 10M has a stop assist 19 on support 18 that is positioned at the end of support 18 that is attached to shaped segment 17. System M is shown in the use position.

In FIG. 13A, system 10N is the same as system 10B in FIG. 7 with the exception a stop assist 19 is mounted on the rigid arm 40 at the start of the second segment 18D as shown in FIG. 13A. System 10N is shown in the use position.

Figure 14:
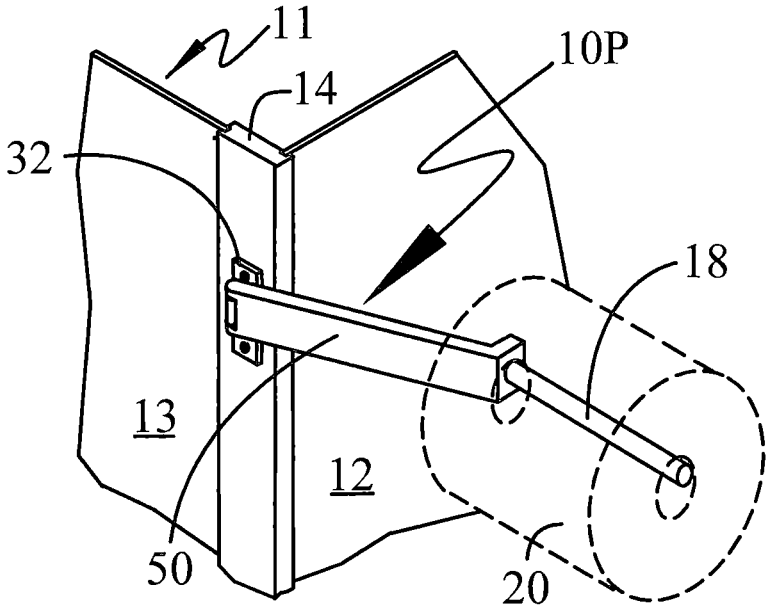
FIG. 14 perspective view system 10P, 2 piece arm with straight shaped arm.

In FIG. 14, system 10P is the same as system 10AA in FIG. 5 with the exceptions that the rigid shaped segment 50 in system 10P is shaped straight and has the shaped bend of arm 50 occurring at the distal end of shaped segment 50 before where shaped segment 50 attaches to support 18 as shown in FIG. 14 and system 10P does not have a stop assist 19 mounted on support 18. System 10P is shown in the use position.

Figure 14A:
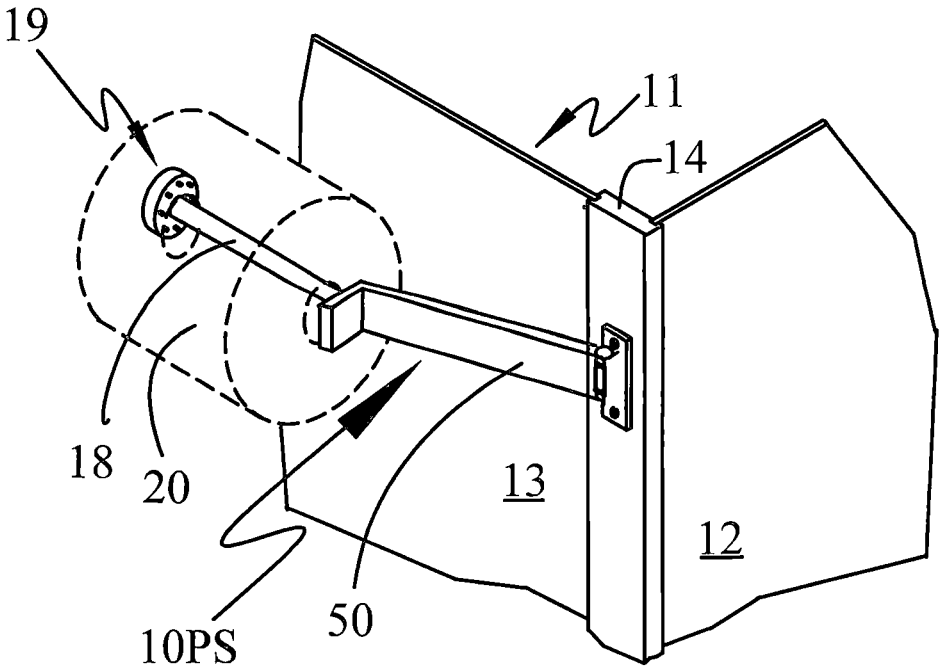
FIG. 14A perspective view system 10PS, 2 piece arm with straight shaped arm, stop assist.

In FIG. 14A, system 10PS is made same as system 10P in FIG. 14 with the exception system 10PS has a stop assist 19 mounted on the end of support 18. System 10PS is shown in the nonuse position.

In FIG. 15, system 10R is made the same as system 10M in FIG. 13 with the exception rigid shaped segment 55 of system 10R is a curved shape from one end to the other end of the rigid shaped segment 55. System 10R is shown in the use position.

Figure 15A:
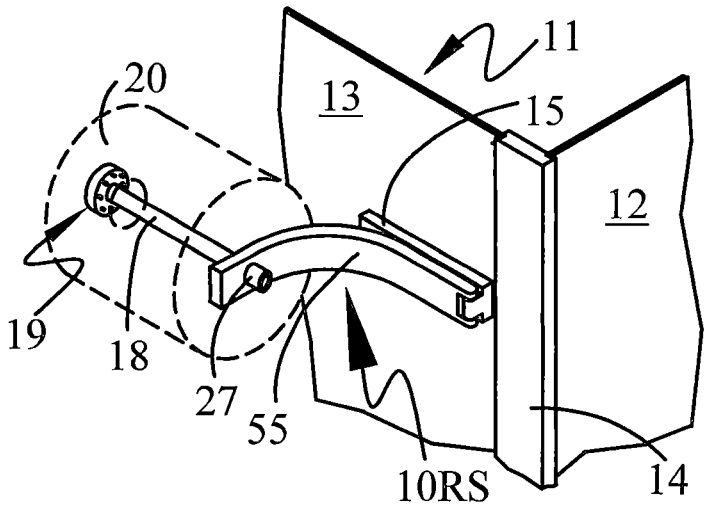
FIG. 15A perspective view system 10RS, 2 piece with curved shaped, stop assist.

In FIG. 15A, system 10RS is the same as system 10R with the exception system 10RS has the stop assist 19 at the distal end of support 18 as shown in FIG. 15A. System 10RS is shown in the nonuse position.

Figure 16:
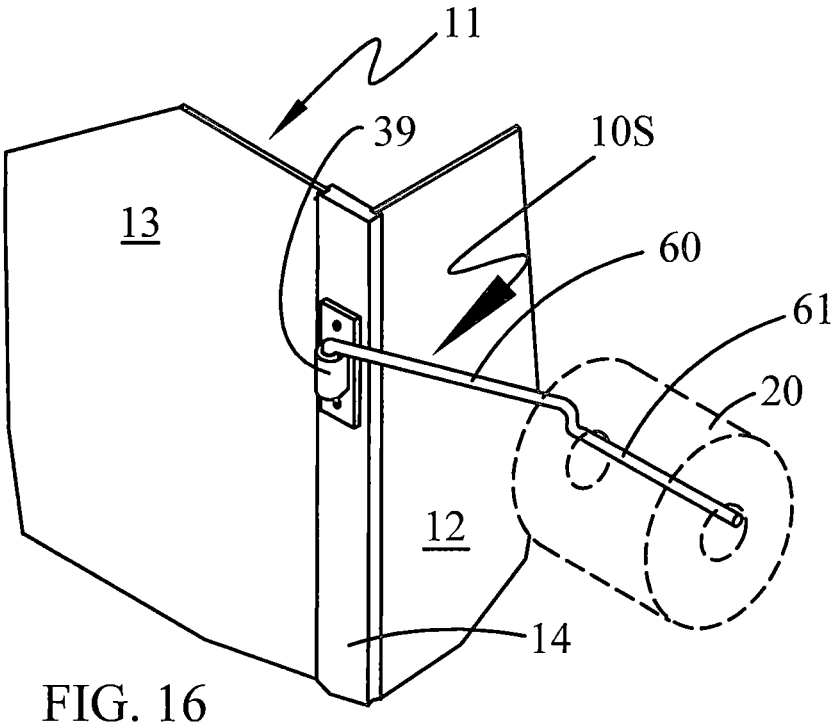
FIG. 16 perspective view system 10S, 1 piece with straight shaped.

In FIG. 16, system 10S is made like system 10B in FIG. 7, with the exception that the rigid shaped segment 60, in system 10S, FIG. 16, is a rigid straight shaped segment 60 until it reaches the second segment 61 where it drops down, then up, then bends to the side and then becomes the second segment 61 as shown in FIG. 16. System 10S is shown in the use position.

Figure 16A:
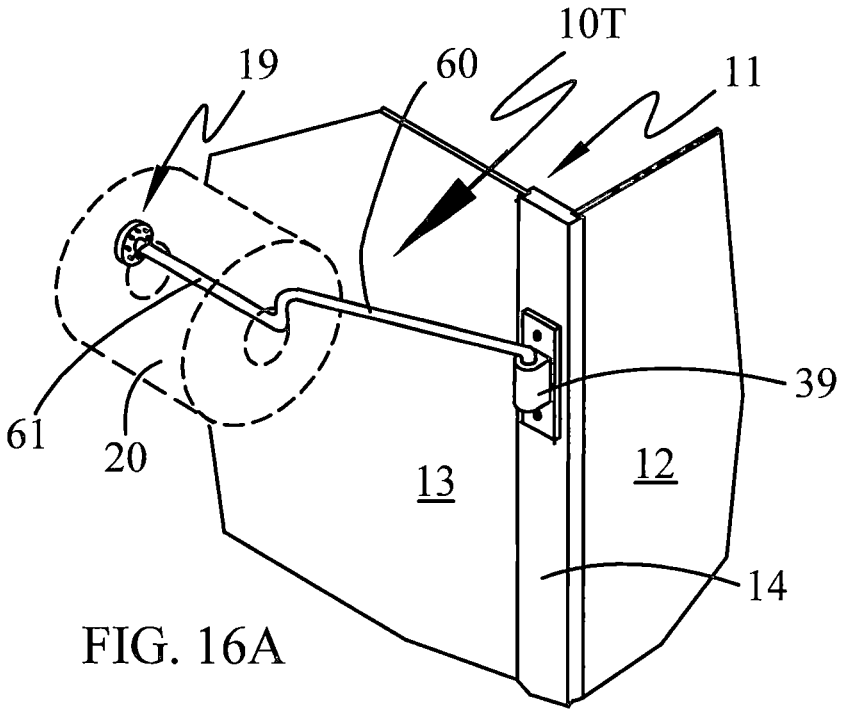
FIG. 16A perspective view system 10T, 1 piece with straight shaped, stop assist.

In FIG. 16A, system 10T is made like system 10S in FIG. 16 with the exception that system 10T has a stop assist 19 at the distal end of second segment 61 as shown in FIG. 16A. System 10T is shown in the nonuse position.

Figure 17:
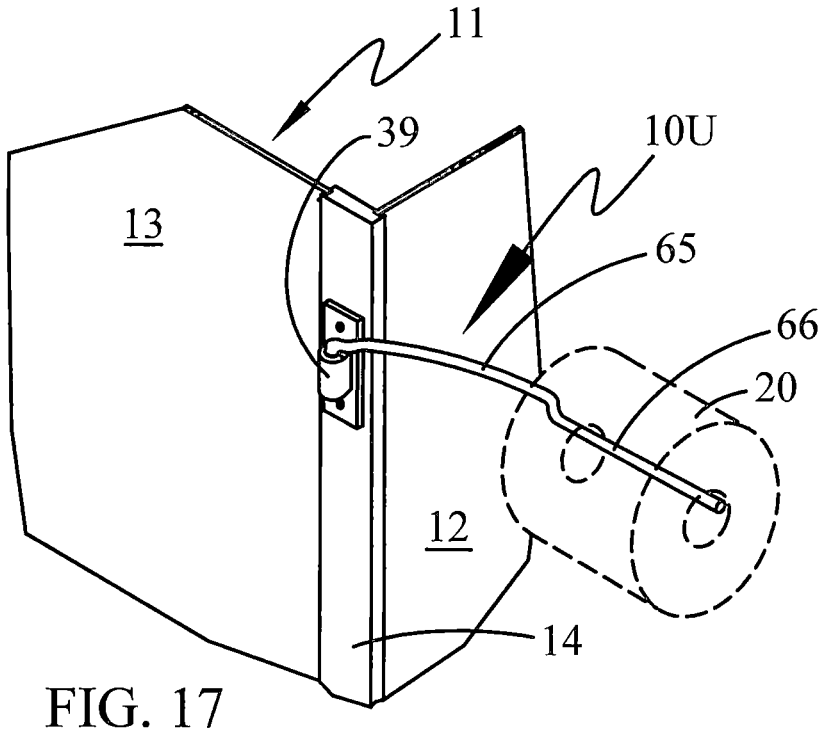
FIG. 17 perspective view system 10U, 1 piece with curved shaped.

In FIG. 17, system 10U is the same as system 10S, in FIG. 16, with the exception that system 10U has shaped segment 65 curved instead of straight as in system 10S in FIG. 16. Second segment 66 supports toilet paper 20. System 10U is shown in the use position.

Figure 17A:
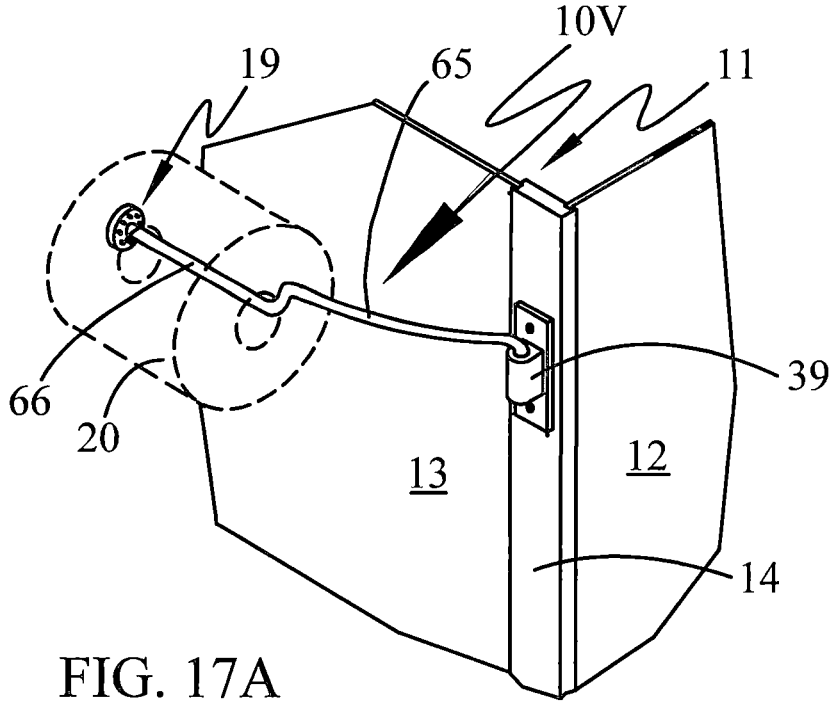
FIG. 17A perspective view system 10V, 1 piece with curved shaped, stop assist.

In FIG. 17A, system 10V is the same as system 10U with the exception that system 10V has a stop assist at the distal end of second segment 66 as shown. System 10V is shown in the nonuse position.

Figure 18:
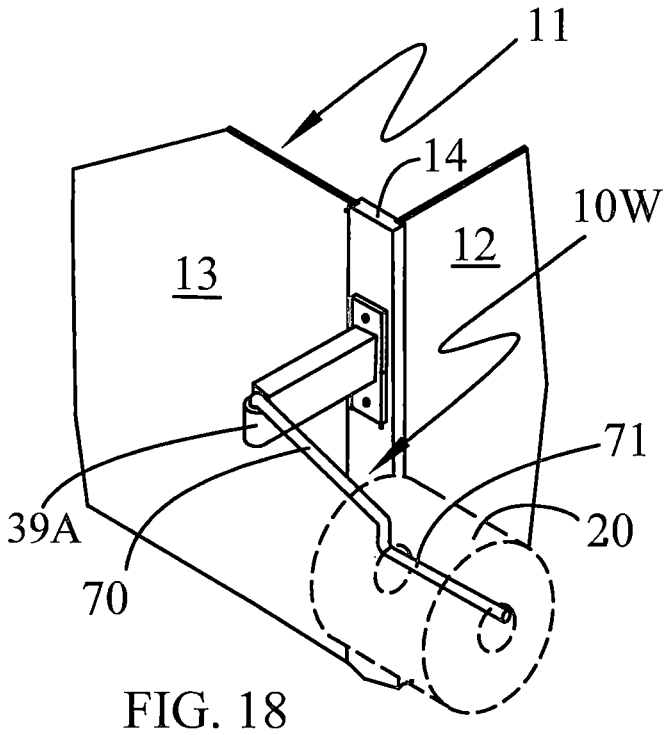
FIG. 18 perspective view system 10W, 1 piece with elongated base, straight shaped.

In FIG. 18, system 10W is the same as system 10E, in FIG. 9, except the rigid shaped segment 70 of system 10W has the shaped segment 70 straight until it reaches the second segment 71 where segment 70 drops down, then up and bends to the side and then becomes segment 71 as shown in FIG. 18. System 10W is shown in the use position.

Figure 18A:
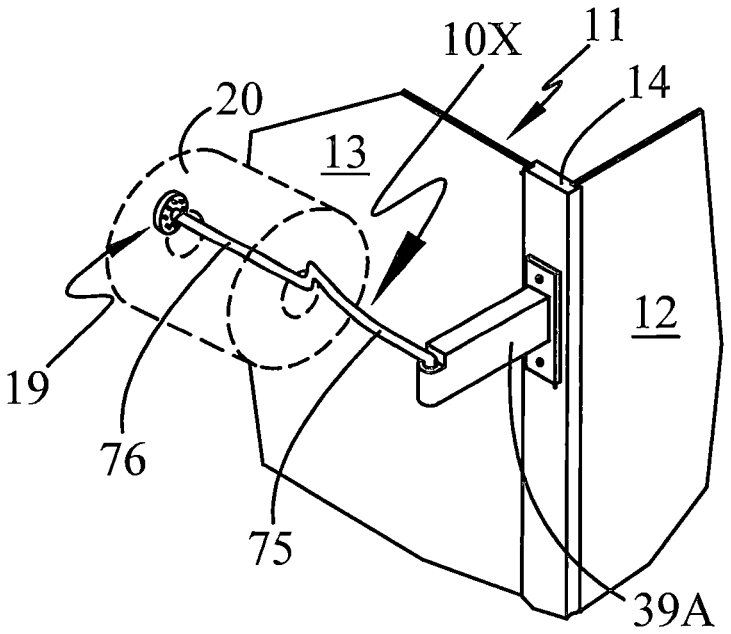
FIG. 18A perspective view system 10X, 1 piece elongated base, curved shaped, stop assist.

In FIG. 18A, system 10X is the same as system 10W except the shaped segment 75 of system 10X has the shaped segment 75 curved until it reaches the second segment 76 where shaped segment 75 drops down, then up, then bends to the side and then becomes second segment 76 as shown in FIG. 18A and system 10X has a stop assist mounted at the distal end of second segment 76. System 10W is shown in the nonuse position.

Figure 19:
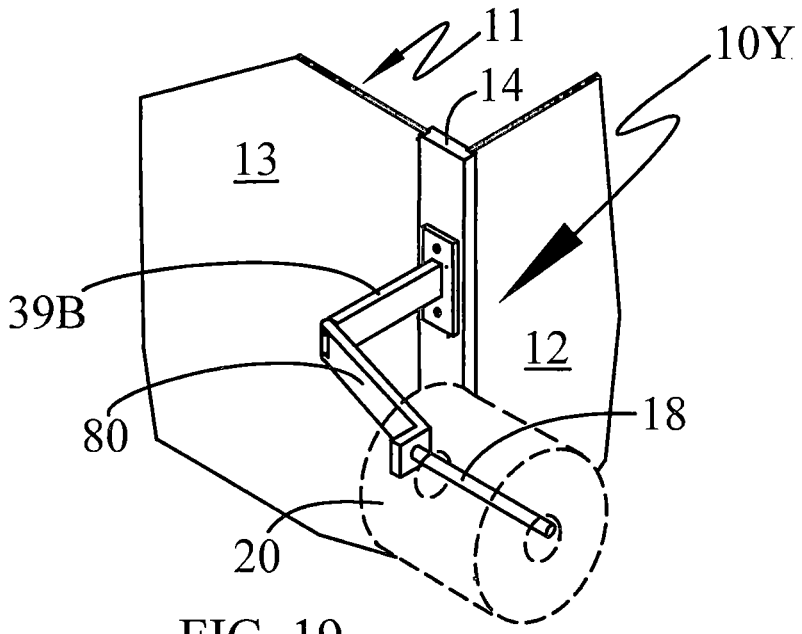
FIG. 19 perspective view system 10Y, 2 piece with elongated base, straight shaped.

In FIG. 19, system 10Y is the same as system 10G, in FIG. 10, with the exception of shaped segment 80 of system 10Y is shaped straight and has a shaped bend of arm 80 occurring just before where shaped segment 80 attaches to support 18 as shown in FIG. 19. System 10Y is shown in the use position.

Figure 19A:
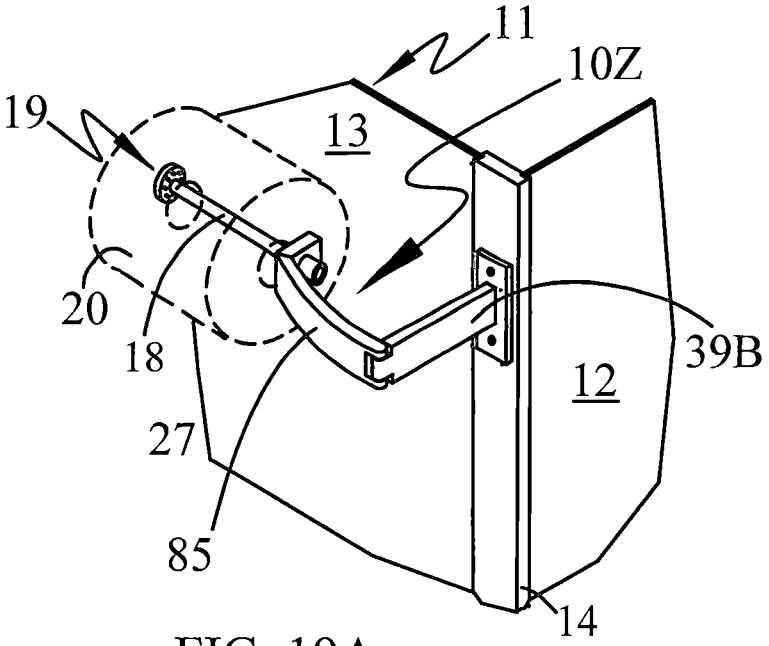
FIG. 19A perspective view system 10Z, 2 piece elongated base, curved shaped, stop assist.

In FIG. 19A, system 10Z is the same as system 10Y with the exceptions that where rigid shaped segment 80 of system 10Y is straight, the rigid shaped segment 85 of system 10Z is curved and has a shaped bend of shaped segment 85 occurring just before where shaped segment 85 attaches to support 18 as shown in FIG. 19A and system 10Z has a stop assist 19 at the distal end of support 18. System 10Z is shown in the nonuse position.

In the following systems the bumper 19B is added to the end of a toilet paper support or second segment to act as a bumper, as in a person may bump into the distal end of the pivoting arm. The bumper 19B may help to prevent the toilet paper roll 20 from accidentally slipping off the end of the support or second segment. The bumper can be made small enough to have the toilet paper slip over the bumper structure for toilet paper installation.

Figure 20:
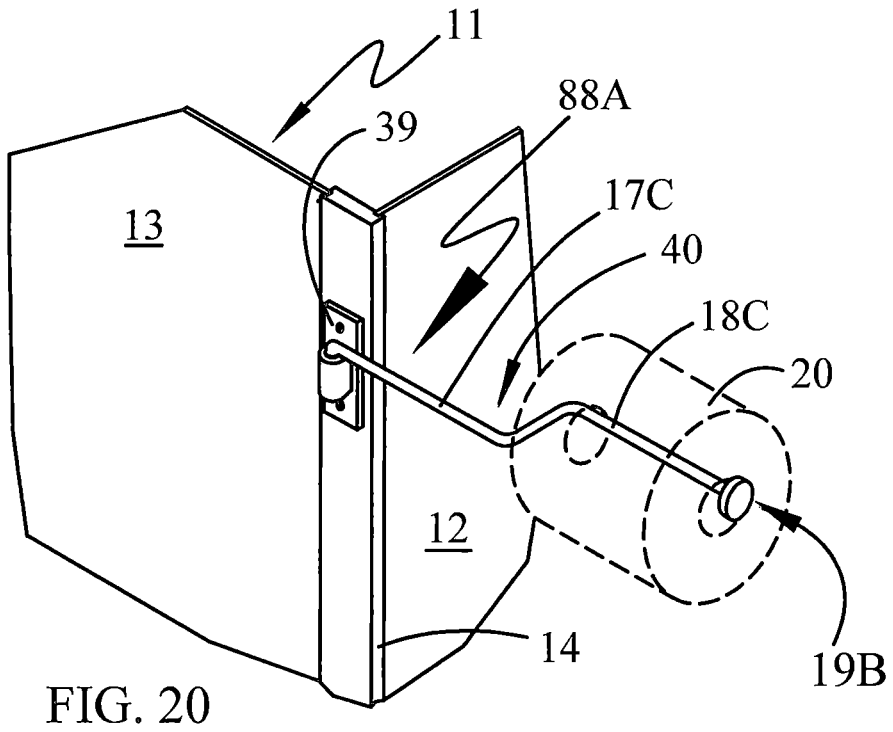
FIG. 20 perspective view system 88A, same as system 10B, 88A has a bumper.

In FIG. 20, system 88A is the same as system 10B, in FIG. 7, with the exception that system 88A has a bumper 19B attached to the end of second segment 18C.

Figure 20A:
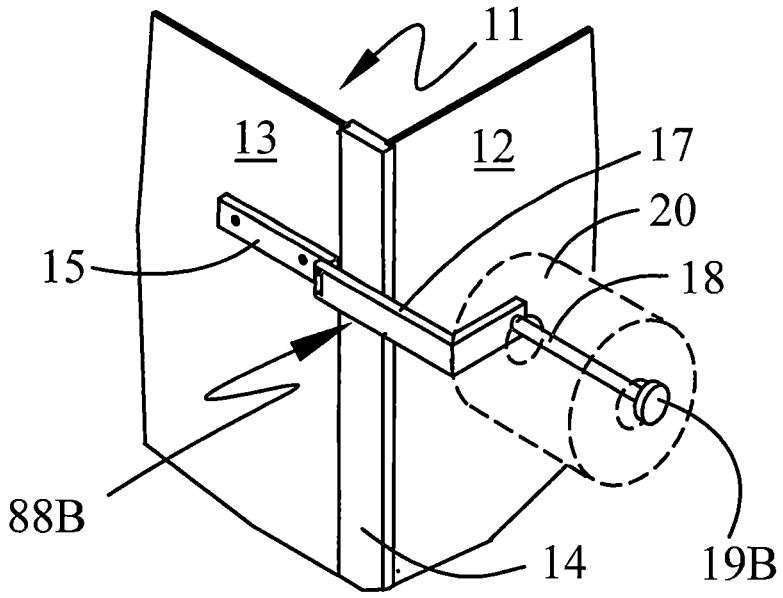
FIG. 20A perspective view system 88B, same as system 10D, 88A has a bumper.

In FIG. 20A system 88B is the same as system 10D, in FIG. 8, with the exception that system 88B has a bumper 19B attached to the end of support 18.

Figure 21:
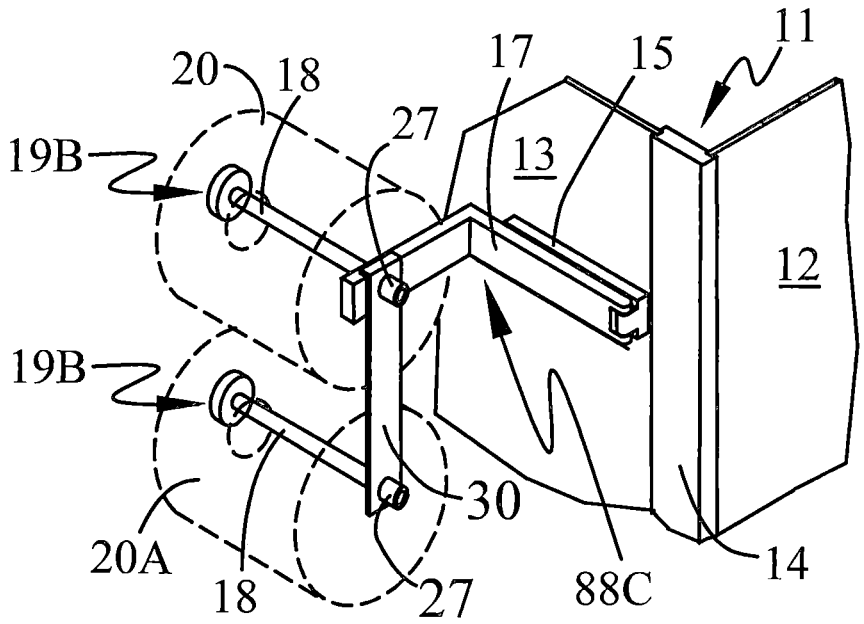
FIG. 21 perspective view system 88C, same as system 10DD, 88A has a bumper.

In FIG. 21 system 88C is the same as system 10DD, in FIG. 8A, with the exception that system 88C has a bumper 19B attached to each end of both supports 18.

Figure 21A:
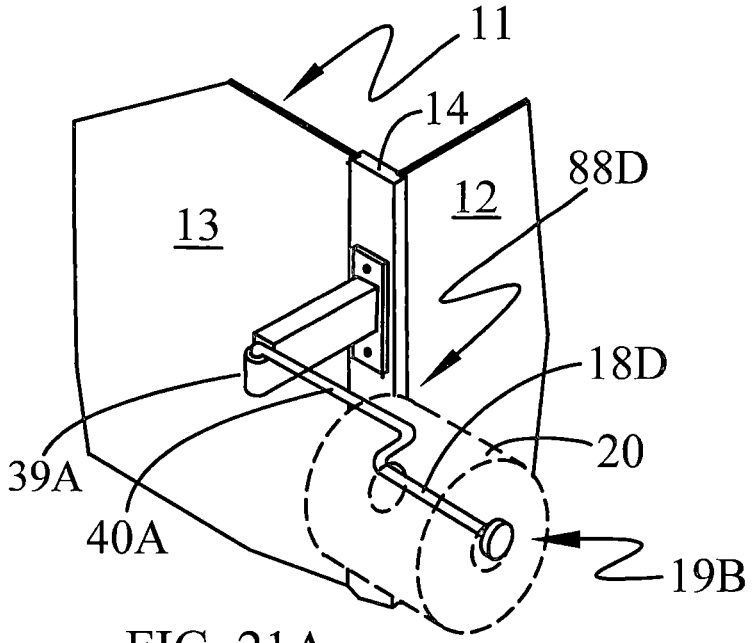
FIG. 21A perspective view system 88D, same as system 10E, 88A has a bumper.

In FIG. 21A system 88D is the same as system 10E, in FIG. 9, with the exception that system 88D has a bumper 19B attached to the second segment 18D.

Figure 22:
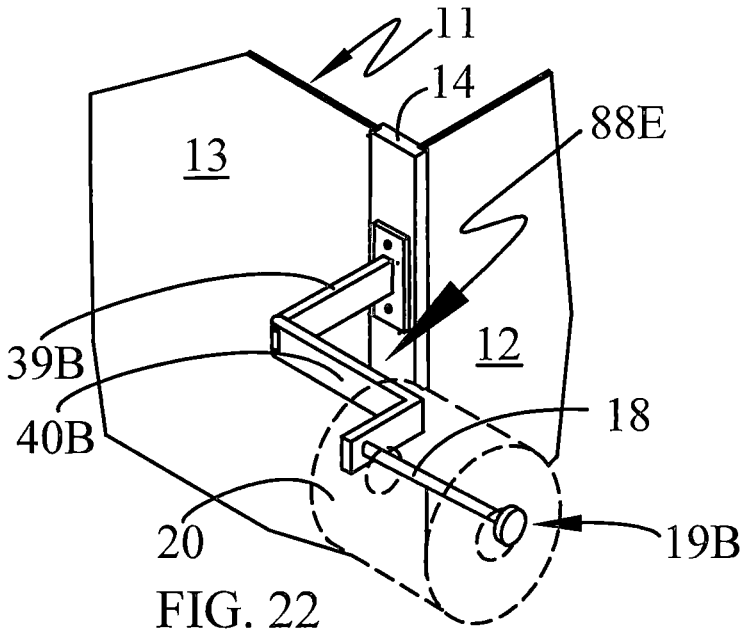
FIG. 22 perspective view system 88E, same as system 10G, 88A has a bumper.

In FIG. 22 system 88E is the same as system 10G, in FIG. 10, with the exception that system 88E has a bumper 19B attached to the end of support 18.

Figure 22A:
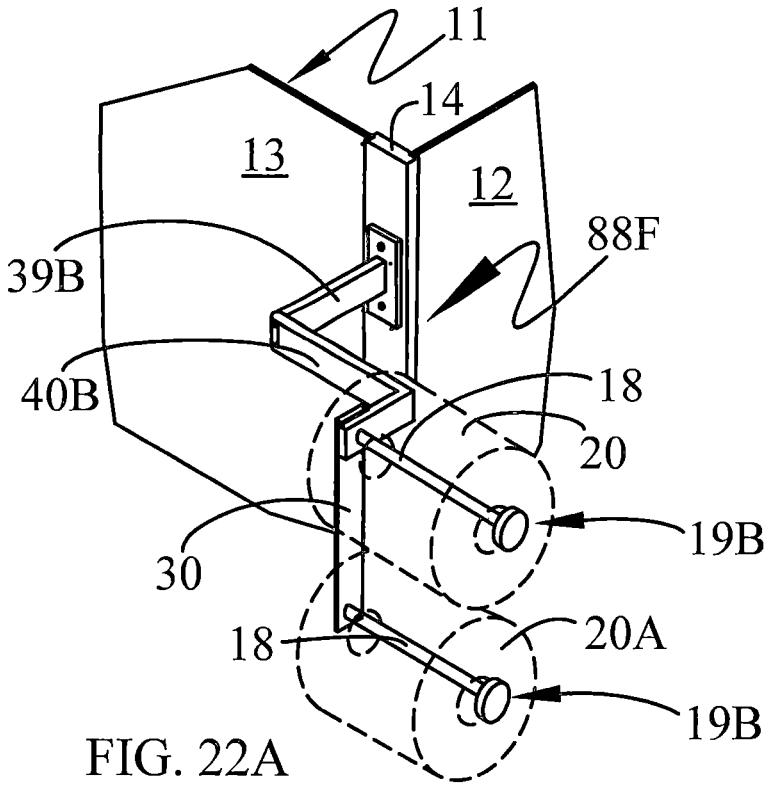
FIG. 22A perspective view system 88F, same as system 10I, 88A has a bumper.

In FIG. 22A system 88F is the same as system 10I, in FIG. 11, with the exception that system 88F has a bumper 19B attached to each end of both supports 18.

Figure 23:
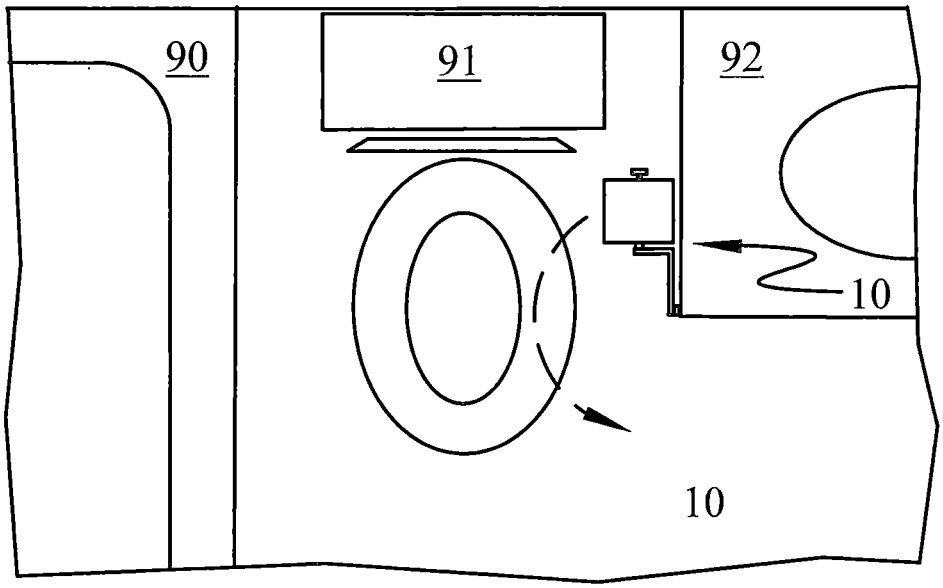
FIG. 23 top view illustrating nonuse position of system 10.
Figure 23A:
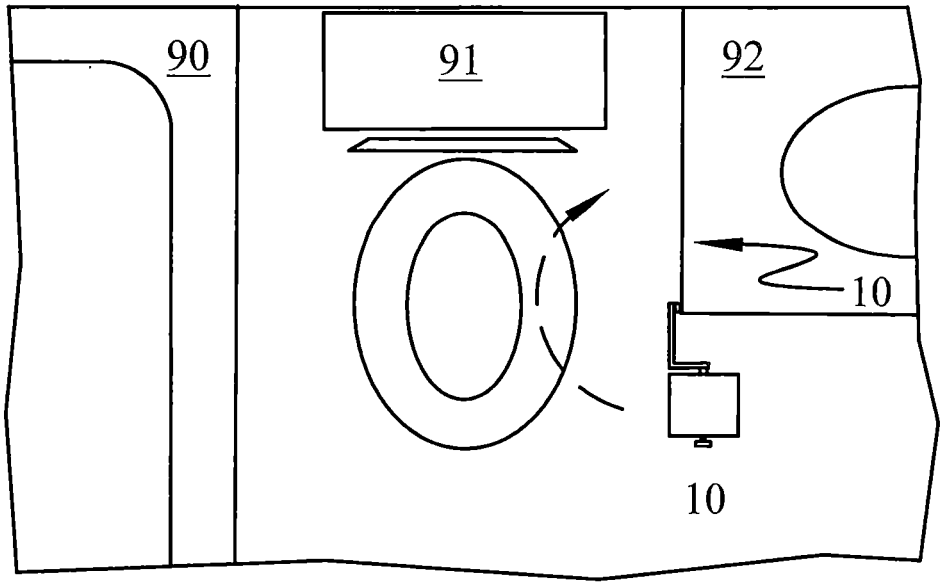

In FIG. 23 is the pivoting toilet paper holder system 10 is a small bathroom with a toilet 91 between a bathtub 90 and a vanity sink 92. The space between the tub 90 and the vanity sink 92 is 30 inches, a code minimum. The system 10 is in the nonuse position positioned on the left side of vanity. This is a location that many toilet paper holders are permanently mounted. Users have to twist and reach back to secure the toilet paper. A user, before sitting down, pivots the system 10 to the use position as shown in FIG. 23A. In the use position the system places the toilet paper forward and around the front of vanity 92 as shown in FIG. 23. After use, the system can be returned to the nonuse position with the toilet paper back on the side of the vanity 92.

The systems can be made of almost any rigid material that is common for bathroom accessories. Examples of common materials for bathroom accessories are stainless steel, solid brass, aluminum, copper, even plastic or wood. While in the preferred embodiment of the stop assist was made of rubber, it too can be made of any of the common bathroom materials used for bathroom accessories.

All the systems described and illustrated herein can be easily made to be used on either side of a toilet, i.e. the design is reversible. This will reduce cost and inventory.

The embodiments described and illustrated here have many ways to meet the system stated objective. They are intended to give a clear understanding how to make, manufacture, and use the the pivoting toilet paper holder that will help solve the problems associated with securing toilet paper in a bathrooms for many people. Many more examples could have been described and illustrated, but they would all be based on the same idea of pivoting the toilet paper roll out of the path of the user to sit down and having the toilet paper holder right where it is easily secured.

I claim:

1. A pivoting toilet paper holder system mounted on a vertical surface providing access to a toilet paper roll with a use and a nonuse position alongside a toilet, comprising:

a base to mount said system to said vertical surface, and a rigid fixed arm structure having a first end, and a second end, having between said first end, and said second end, a first segment and a second segment, wherein said first end is pivotally attached to said base, and said first segment is a shaped segment, having a first bend, and a second bend, wherein said first bend is a fixed shaped bend formed at an angle towards said toilet when said system is in said nonuse position and said second bend is a fixed shaped bend formed at an angle that is substantially the same said angle as said first fixed shaped bend angle however said second fixed shaped bend angle is formed in the opposite direction of said angle of said first bend, and said second segment having a first end, and a second end, wherein said second segment provides support for said toilet paper roll.

2. The system as set forth in claim 1, wherein said second segment having a first end, and a second end, wherein said second segment provides support for said toilet paper roll is an attached toilet paper roll support having a first end and a second end.

3. The system as set forth in claim 2, wherein said second end of said toilet paper roll support further having a stop assist comprising a stop assist structure, and a plurality of pegs, wherein said stop assist structure having said plurality of pegs positioned in said stop assist structure, wherein said plurality of pegs are pointing towards said toilet paper.

4. The system as set forth in claim 1, further comprising a second roll structure for a second toilet paper roll comprising, a rigid connector structure, and a second toilet paper roll support, wherein said rigid connector structure having two ends, a first end, and a second end, and said second toilet paper roll support having a first end, and a second end, wherein said first end of said rigid connector structure is rigidly attached to said rigid fixed arm structure, and said first end of said second toilet paper roll support is rigidly attached to said second end of said rigid connector structure.

5. The system as set forth in claim 4, wherein said second end of said second toilet paper roll support further having a stop assist comprising a stop assist structure, and a plurality of pegs, wherein said stop assist structure having said plurality of pegs positioned in said stop assist structure, wherein said plurality of pegs are pointing towards said toilet paper.

6. The system as set forth in claim 1, wherein said second end of said rigid fixed arm structure further having a stop assist comprising a stop assist structure, and a plurality of pegs, wherein said stop assist structure having said plurality of pegs positioned in said stop assist structure wherein said plurality of pegs are pointing towards said toilet paper.

7. The system as set forth in claim 1, wherein said first end is pivotally attached to said base, and said first segment is a shaped segment, having a first bend, and said second segment having a first end, and a second end that provides support for said toilet paper roll, whereas said first bend of said first segment is a fixed shaped bend formed at an angle that positions said second segment to be parallel to said vertical surface when said system is in said nonuse position supporting a new unused said toilet paper roll.

8. The system as set forth in claim 1, wherein said first end is pivotally attached to said base, and said first segment is a non uniform curve shaped segment and said second segment having a first end, and a second end that provides support for said toilet paper roll, whereas said first segment non uniform curve positions said second segment to be parallel to said vertical surface when said system is in said nonuse position supporting a new unused said toilet paper roll.

9. The system as set forth in claim 1, further comprising a friction washer placed at the pivoting point of said system that provides increased resistance to the pivoting action to aid in holding desired positions.

10. The system as set forth in claim 1, further comprising a detent to temporary hold said system in said use and said nonuse positions.

11. A pivoting toilet paper holder system mounted on a vertical surface providing access to a toilet paper roll with a use and a nonuse position alongside a toilet, comprising:

a base to mount said system to said vertical surface, wherein said base having an elongated structure having a distal end protruding away from said vertical surface, and a rigid fixed arm structure having a first end, and a second end, having between said first end, and said second end, a first segment and a second segment, wherein said first end is pivotally attached to said distal end of said elongated structure of said base, and said first segment is a shaped segment, having a first bend, and a second bend, wherein said first bend is a fixed shaped bend formed at an angle towards said toilet when said system is in said use position and said second bend is a fixed shaped bend formed at an angle that is substantially the same said angle as said first fixed shaped bend angle however said second fixed shaped bend angle is formed in the opposite direction of said angle of said first bend, and said second segment having a first end, and a second end, wherein said second segment provides support for said toilet paper roll.

12. The system as set forth in claim 11, wherein said second segment having a first end, and a second end, wherein said second segment provides support for said toilet paper roll is an attached toilet paper roll support having a first end and a second end.

13. The system as set forth in claim 12, wherein said second end of said toilet paper roll support further having a stop assist comprising a stop assist structure, and a plurality of pegs, wherein said stop assist structure having said plurality of pegs positioned in said stop assist structure wherein said plurality of pegs are pointing towards said toilet paper.

14. The system as set forth in claim 11, further comprising a second roll structure for a second toilet paper roll comprising a rigid connector structure, and a second toilet paper roll support, wherein said rigid connector structure having two ends, a first end, and a second end, and said second toilet paper roll support having a first end, and a second end, wherein said first end of said rigid connector structure is rigidly attached to said rigid fixed arm structure, and said first end of said second toilet paper roll support is rigidly attached to said second end of said rigid connector structure.

15. The system as set forth in claim 14, wherein said second end of said second toilet paper roll support further having a stop assist comprising a stop assist structure, and a plurality of pegs, structure wherein said plurality of pegs are pointing towards said toilet paper.

16. The system as set forth in claim 11, wherein said second end of said rigid fixed arm structure further having a stop assist comprising a stop assist structure, and a plurality of pegs, wherein said stop assist structure having said plurality of pegs positioned in said stop assist structure wherein said plurality of pegs are pointing towards said toilet paper.

17. The system as set forth in claim 4, further comprising a friction washer placed at the pivoting point of said system that provides increased resistance to the pivoting action to aid in holding desired positions.

18. The system as set forth in claim 11, further comprising a detent to temporary hold said system in said use and said nonuse positions.

19. A pivoting toilet paper holder system providing access to a toilet paper roll mounted on a handicap toilet safety rail frame, alongside a toilet having a use position and a nonuse position comprising:

an adjustable base to mount said system to said handicap toilet safety rail frame comprising, a rotating pivot assembly comprising, a pivoting plate attachment having mounting holes, a mounting structure having a first end, and a second end, having between said first end and said second end a first slot, a second slot, and a bend, wherein said first slot has a first clamp to mount said mounting structure to said frame, said second slot has a second clamp to mount said mounting structure to said frame, and said bend is a fixed shaped bend in a direction away from said toilet wherein between said bend and said second end having mounting holes to mount said rotating pivot assembly, a rigid fixed arm structure having a first end, and a second end, having between said first end, and said second end, a first segment, and a second segment wherein said first end is pivotally attached to said base, said first segment is a fixed shaped segment having a first bend, a second bend, and a third bend wherein said first bend is a fixed shaped bend formed at an angle in the direction towards the first end of said mounting structure but also significantly parallel to said mounting structure when said system is in the nonuse position, the second bend is a fixed shaped bend formed at an angle in the direction down, and said third bend is a fixed shape bend formed at an angle that is substantially the same angle as said second fixed shaped angle, however said third fixed shaped angle is in the opposite direction of said second fixed shaped angle and is also in the direction towards the first end of said mounting structure but also significantly parallel to said mounting structure when said system is in said nonuse position, and said second segment begins after said third bend of said first segment ends and said second segment ends at said second end of said rigid fixed arm structure and said second segment supports said toilet paper roll.

20. The system as set forth in claim 19, wherein said second end of said rigid fixed arm structure further having a stop assist comprising a stop assist structure, and a plurality of pegs, wherein said stop assist structure having said plurality of pegs positioned in said stop assist structure wherein said plurality of pegs are pointing towards said toilet paper.

* * * * *